US007673693B2

(12) United States Patent
Standridge et al.

(10) Patent No.: US 7,673,693 B2
(45) Date of Patent: Mar. 9, 2010

(54) HYDRAULIC COILED TUBING RETRIEVABLE BRIDGE PLUG

(75) Inventors: William E. Standridge, Duncan, OK (US); Cleo (John) Clayton Holland, Duncan, OK (US); Kevin Ray Manke, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 265 days.

(21) Appl. No.: 11/762,514

(22) Filed: Jun. 13, 2007

(65) Prior Publication Data

US 2008/0308282 A1 Dec. 18, 2008

(51) Int. Cl.
*E21B 33/12* (2006.01)

(52) U.S. Cl. ..... 166/387; 166/123; 166/182

(58) Field of Classification Search ..... 166/118, 166/134, 387, 123, 120, 119, 386, 98, 294
See application file for complete search history.

(56) References Cited

U.S. PATENT DOCUMENTS

| | | | | | |
|---|---|---|---|---|---|
| 2,378,469 | A | | 6/1945 | Denton | |
| 3,220,480 | A | * | 11/1965 | Myers | 166/63 |
| 3,509,940 | A | | 5/1970 | Young | |
| 3,526,277 | A | | 9/1970 | Scott | |
| 3,987,847 | A | | 10/1976 | Craig | |
| 4,427,063 | A | | 1/1984 | Skinner | |
| 4,646,829 | A | | 3/1987 | Barrington et al. | |
| 4,796,707 | A | * | 1/1989 | Halbardier | 166/387 |
| 4,805,699 | A | | 2/1989 | Halbardier | |
| 5,020,600 | A | * | 6/1991 | Coronado | 166/387 |
| 5,074,361 | A | * | 12/1991 | Brisco et al. | 166/301 |
| 5,224,547 | A | * | 7/1993 | Burns et al. | 166/301 |
| 5,332,038 | A | * | 7/1994 | Tapp et al. | 166/278 |
| 5,343,956 | A | * | 9/1994 | Coronado | 166/387 |
| 5,413,170 | A | * | 5/1995 | Moore | 166/85.1 |
| 6,131,663 | A | | 10/2000 | Henley et al. | |
| 6,164,378 | A | | 12/2000 | Coronado | |

(Continued)

FOREIGN PATENT DOCUMENTS

GB 1099817 1/1968

OTHER PUBLICATIONS

"Isolator (R) Retrievable Bridge Plug," Halliburton Service Tools Manual, Nov. 2006, pp. front cover + 2-16 through 2-17 + back cover (4 pgs.).

(Continued)

*Primary Examiner*—Jennifer H Gay
*Assistant Examiner*—Kipp C Wallace
(74) *Attorney, Agent, or Firm*—John W. Wustenberg; Conley Rose, P.C.

(57) ABSTRACT

A zonal isolation device comprises a packer assembly and an internal setting mechanism operable to actuate the packer assembly from an unset position to a set position, wherein the zonal isolation device is resettable and retrievable. Another zonal isolation device comprises a packer assembly, a setting mechanism operable to actuate the packer assembly from an unset position to a set position in response to hydraulic pressure alone, and a locking mechanism operable to lock and unlock the packer assembly from the set position in response to hydraulic pressure alone. A method for setting a zonal isolation device within a well bore comprises running the zonal isolation device in an unset position within the well bore on a work string, applying a differential pressure between the work string and the well bore, and actuating the zonal isolation device to a set position in response to the differential pressure alone.

19 Claims, 26 Drawing Sheets

U.S. PATENT DOCUMENTS

| | | | | |
|---|---|---|---|---|
| 6,481,497 | B2 * | 11/2002 | Swor et al. | 166/134 |
| 6,736,214 | B2 * | 5/2004 | Hoffman et al. | 166/387 |
| 6,957,701 | B2 | 10/2005 | Tolman et al. | |
| 7,036,602 | B2 * | 5/2006 | Turley et al. | 166/387 |
| 2004/0129423 | A1 | 7/2004 | Eddison | |
| 2004/0216868 | A1 | 11/2004 | Owen, Sr. | |
| 2005/0199399 | A1 | 9/2005 | Hayter et al. | |
| 2005/0284637 | A1 * | 12/2005 | Stegent et al. | 166/308.1 |
| 2007/0012461 | A1 * | 1/2007 | Morgan | 166/387 |
| 2007/0051521 | A1 * | 3/2007 | Fike et al. | 166/387 |
| 2007/0119600 | A1 * | 5/2007 | Slup et al. | 166/387 |

OTHER PUBLICATIONS

"Model 3L Retrievable Bridge Plug," Halliburton Service Tools Manual, Nov. 2006, pp. front cover + 2-18 through 2-19 + back cover (4 pgs.).

"Model N Quick Retrievable Bridge Plug," Halliburton Service Tools Manual, Nov. 2006, pp. front cover + 2-20 through 2-21 + back cover (4 pgs.).

"TW Shorty Retrievable Bridge Plug," Halliburton Service Tools Manual, Nov. 2006, pp. front cover + 2-22 + back cover (3 pgs.).

"BV Retrievable Bridge Plug," Halliburton Service Tools Manual, Nov. 2006, pp. front cover + 2-23 through 2-24 + back cover (4 pgs.).

"Express Bridge Plug," Halliburton Energy Services, Inc., H01033, Jun. 1998 (2 pgs.).

Stricker, M.P., et al., "Coiled Tubing Conveyed Fracturing System Allows Longer Zones to be Isolated in a Single Trip Multiple Times," SPE 94085, 2005 SPE/ICoTA Coiled Tubing Conference and Exhibition, The Woodlands, Texas, Apr. 12-13, 2005, Society of Petroleum Engineers, Inc., pp. 1-9 (9 pgs.).

* cited by examiner

HYDRAULIC COILED TUBING RETRIEVABLE BRIDGE PLUG

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to hydrocarbon well workover tools and more particularly, to zonal isolation devices for use during well workovers and methods of using the zonal isolation devices.

BACKGROUND

The hydrocarbon industry employs a variety of downhole tools during production and well workovers. A zonal isolation device is one such type of tool. Zonal isolation devices are used in a variety of settings to block or control the flow of fluids in a well bore. Examples of zonal isolation devices may include bridge plugs, fracture plugs, or any other device capable of separating pressure and flow zones within a well bore. Production zonal isolation devices seal off a portion of a well during production of hydrocarbons. Retrievable zonal isolation devices may be employed during well workovers when they are not intended to remain in the well during production. The retrievable zonal isolation device performs a number of functions, including but not limited to: isolating one pressure zone of a well bore formation from another, protecting the production liner or casing from reservoir pressure and erosion that may be caused by workover fluids, and eliminating or reducing pressure surging or heading.

Retrievable zonal isolation devices may be used during well workovers. During a typical well workover, a section of the well bore is isolated using a zonal isolation device, which may typically be a bridge plug. The isolated portion is then subjected to treatments intended to increase the flow of hydrocarbons from the well. In a typical well workover, several such isolated intervals may require treatment. Traditionally, a temporary bridge plug has been set to define an interval. After each treatment, the work string is removed to allow for the addition of another bridge plug to define the next interval. At the end of the workover, the bridge plugs are milled out. The rig time required to set multiple bridge plugs and thereafter remove the plugs can negatively impact the economics of the project, as well as add unacceptable complications and risks.

Traditional zonal isolation devices used during well workovers are set in place using rotational and longitudinal movement. The zonal isolation device may be run down on production tubing or coiled tubing to a desired depth in the well bore before being set. Conventional zonal isolation devices are then set using rotation, typically provided by rotating the tubing string at the wellhead. The rotation expands a set of slips that engage the inside of a production liner or casing. Following the setting of the slips with rotation, the weight of the tubing string is then set down on the bridge plug to fully engage the sealing elements. In this way, the zonal isolation device provides a seal between the zonal isolation device and the inside of a production liner or casing. While conventional production tubing possesses the mechanical strength and properties for applying a rotational force to the bridge plug, coiled tubing is not readily capable of being rotated. Further, highly deviated wells and extended reach wells may cause friction on conventional tubing that may prevent it from being used to provide an effective rotational or set down force on the bridge plug. In these wells and in wells in which the bridge plug is run on coiled tubing, only longitudinal force and hydraulic pressure may be used to set a bridge plug. Therefore, a need exists for a retrievable zonal isolation device that is capable of being set using longitudinal movement and hydraulic pressure and that may be set, unset, and reset multiple times during a single trip into the well bore.

SUMMARY OF THE INVENTION

The present disclosure is directed to a zonal isolation device for use within a well bore. In an embodiment, the zonal isolation device comprises a hydraulic setting mechanism. In an embodiment, the hydraulic setting mechanism may actuate the zonal isolation device using hydraulic pressure alone. The present disclosure is also directed to a zonal isolation device comprising a hydraulic setting mechanism that may be set, unset, and reset multiple times during a single trip in the well bore.

In one aspect, the present disclosure is directed to zonal isolation device comprising a packer assembly and an internal setting mechanism operable to actuate the packer assembly from an unset position to a set position wherein the zonal isolation device is resettable and retrievable. In various embodiments, the internal setting mechanism is hydraulically actuated and/or does not detach from the packer assembly and/or is positioned generally toward a lower end of the zonal isolation device. The zonal isolation device may further comprise a locking mechanism selectively operable to maintain the packer assembly in the set position and release the packer assembly from the set position. In an embodiment, the locking mechanism is hydraulically actuated. The locking mechanism may comprise a piston and a locking member. In an embodiment, the zonal isolation device is a bridge plug. A downhole assembly may comprise the zonal isolation device connected to a non-rotatable work string. In an embodiment of the downhole assembly, the packer assembly comprises opposable slips.

In another aspect, the present disclosure is directed to a zonal isolation device comprising a packer assembly, a setting mechanism operable to actuate the packer assembly from an unset position to a set position in response to hydraulic pressure alone, and a locking mechanism operable to lock and unlock the packer assembly from the set position in response to hydraulic pressure alone. In an embodiment, the device is resettable and retrievable. An assembly may comprise the zonal isolation device connected to a coiled tubing work string. In an embodiment of the assembly, the packer assembly comprises opposable slips.

In still another aspect, the present disclosure is directed to a zonal isolation device comprising a mandrel having a fluid flow bore disposed therein, a coupling portion comprising an upper, releasable portion coupled to a work string and a lower portion coupled to the mandrel, an annular packer portion comprising at least one sealing element disposed around the mandrel and at least one slip disposed around the mandrel, a hydraulic setting portion comprising a piston disposed between the mandrel and an outer piston case wherein the hydraulic setting portion provides the setting force from hydraulic pressure alone, a means of controlling pressure within the hydraulic setting portion, and a valve for controlling fluid flow through the zonal isolation device. In an embodiment, the work string may comprise a coiled tubing string, or the work string may comprise a tubing string with one or more tools connected between the zonal isolation device and an end of the tubing string. In an embodiment, the annular packer portion may further comprise a ratchet for maintaining the tool in an actuated state. In another embodiment, the mandrel may further comprise a continuous J-slot for setting the actuated state of the device. The zonal isolation device may further comprise a locking mechanism for maintaining the zonal isolation device in an actuated position, and in an embodiment, the locking mechanism may comprise a locking arm that extends over an edge of the piston case. In an embodiment, the hydraulic setting portion may reset the zonal isolation device. In an embodiment, the zonal isolation device may be a retrievable bridge plug or a fracture plug.

In yet another aspect, the present disclosure is directed to a hydraulic setting mechanism for a down hole tool comprising a mandrel extending longitudinally through the down hole tool and a piston case, and a hydraulically actuated piston disposed between the piston case and the mandrel, wherein the hydraulically actuated piston provides the setting force via hydraulic pressure alone. In an embodiment, the hydraulic setting mechanism may be actuated using fluid pressure supplied through coiled tubing. The hydraulic setting mechanism may be reset using hydraulic pressure and longitudinal mandrel movement. The hydraulic setting mechanism may further comprise a valve for controlling a pressure within the hydraulic setting mechanism, and in an embodiment, the valve may be a velocity check valve. The hydraulic setting mechanism may further comprise a locking mechanism for locking the hydraulic setting mechanism in an actuated position.

In a further aspect, the present disclosure is directed to a method of performing a down hole procedure comprising running a tool string in a well bore wherein the tool string comprises at least a zonal isolation device, setting the zonal isolation device hydraulically, performing the down hole procedure, unsetting the zonal isolation device, and either repositioning the zonal isolation device and performing another down hole procedure, or retrieving the zonal isolation device. In an embodiment, the hydraulically actuated zonal isolation device is set using hydraulic pressure alone and is unset using hydraulic pressure and longitudinal tool string movement.

In still another aspect, the present disclosure is directed to a method of locking a zonal isolation device comprising actuating the hydraulic setting portion by flowing fluid through the mandrel to actuate the pressure control means, and pressurizing the hydraulic setting mechanism to engage the locking mechanism. The method may further comprise unlocking and resetting the zonal isolation device by reactuating the hydraulic setting portion when it is in a locked state, relieving pressure from the tool, and longitudinally raising the mandrel.

In yet another aspect, the present disclosure is directed to a method for setting a zonal isolation device within a well bore comprising running the zonal isolation device in an unset position to a first location within the well bore on a work string, applying a first differential pressure between the work string and the well bore, and actuating the zonal isolation device to a set position in response to the first differential pressure alone. The method may further comprise locking the zonal isolation device in the set position in response to the first differential pressure. In an embodiment, the method further comprises releasing the zonal isolation device from the work string and performing the well bore operation. The method may further comprise reconnecting the work string to the zonal isolation device, applying a second differential pressure between the work string and the well bore, unlocking the zonal isolation device from the set position in response to the second differential pressure alone, and moving the zonal isolation device to the unset position. In an embodiment, the method further comprises running the zonal isolation device in the unset position to a second location within the well bore on the work string, applying a third differential pressure between the work string and the well bore, and actuating the zonal isolation device to the set position in response to the third differential pressure alone. The method may further comprise retrieving the zonal isolation device from the well bore.

NOTATION AND NOMENCLATURE

Figure 1:
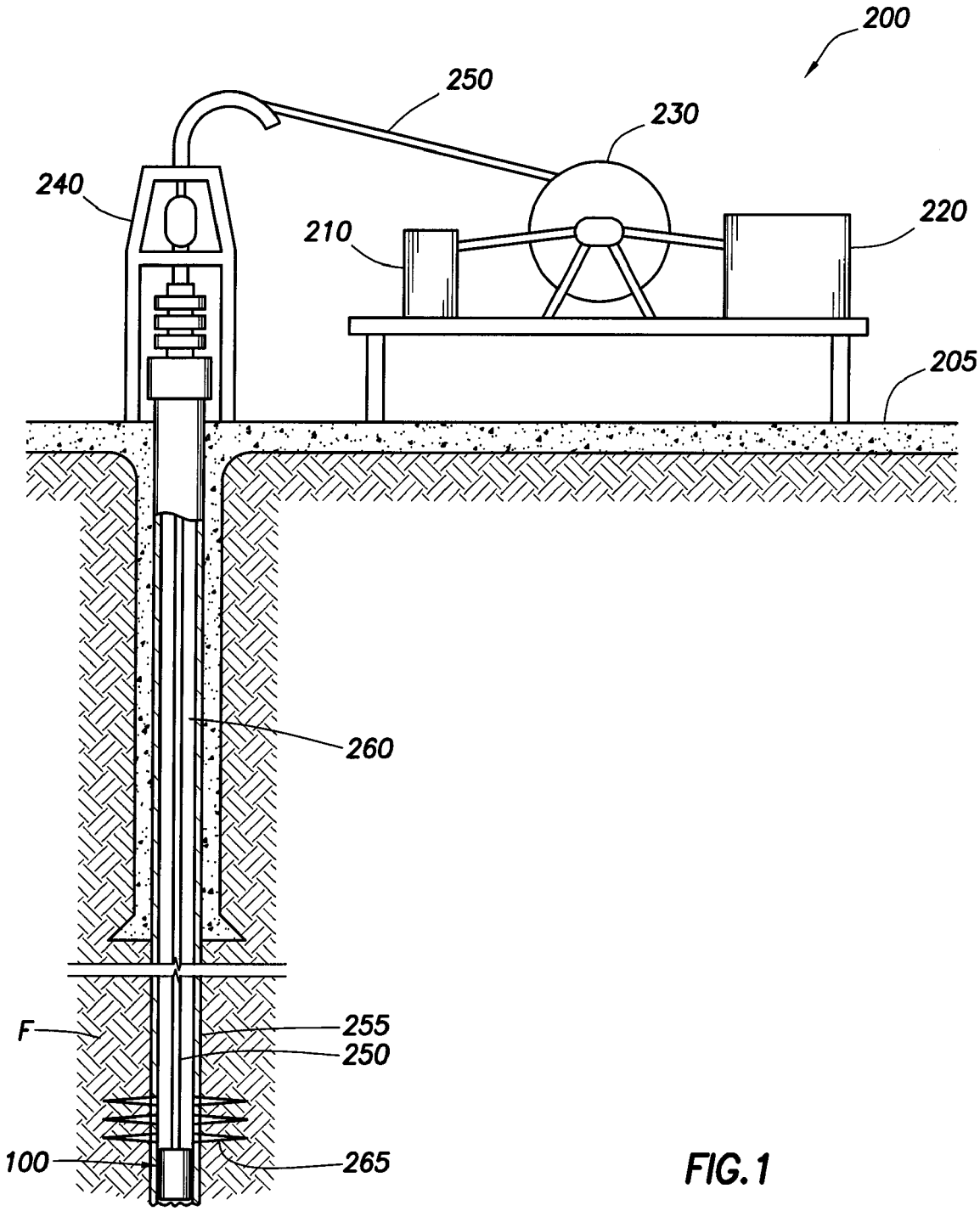
FIG. 1 provides a schematic side view, partially cross-sectional, of a representative operating environment for a zonal isolation device system employed within a well bore.

Certain terms are used throughout the following description and claims to refer to particular structural components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", "upwardly", "upstream", "on top", or "above" meaning toward the surface of the well and with "down", "lower", "downwardly", "downstream", "on bottom", or "below" meaning toward the bottom end of the well, regardless of the well bore orientation.

As used herein, the terms "bottom-up" and "top-down" will be used as adjectives to identify the direction of a force that actuates a downhole tool, with "bottom-up" generally referring to a force that is exerted from the bottom of the tool upwardly toward the surface of the well, and with "top-down" generally referring to a force that is exerted from the top of the tool downwardly toward the bottom end of the well, regardless of the well bore orientation.

As used herein, the terms "hydraulic" and "hydraulically actuated" will be used to identify actuating or setting modules that are actuated by applying a differential fluid pressure across a moveable piston.

As used herein, the term "balanced valve" will be used broadly to identify any type of actuatable device operable to selectively open a port while not responsive to differential pressure about the valve, including but not limited to a sliding sleeve, a shifting sleeve, and a shear plug device, for example.

As used herein, the term "zonal isolation device" will be used to identify any type of actuatable device operable to control the flow of fluids or isolate pressure zones within a well bore, including but not limited to a bridge plug and a fracture plug. The term zonal isolation device may be used to refer to a permanent device or a retrievable device.

As used herein, the term "bridge plug" will be used to identify a downhole tool that may be located and set to isolate a lower part of the well bore below the downhole tool from an upper part of the well bore above the downhole tool. The term bridge plug may be used to refer to a permanent device or a retrievable device.

As used herein, the terms "seal", "sealing", "sealing engagement" or "hydraulic seal" are intended to include a "perfect seal", and an "imperfect seal. A "perfect seal" may refer to a flow restriction (seal) that prevents all fluid flow across or through the flow restriction and forces all fluid to be redirected or stopped. An "imperfect seal" may refer to a flow restriction (seal) that substantially prevents fluid flow across or through the flow restriction and forces a substantial portion of the fluid to be redirected or stopped.

DETAILED DESCRIPTION

The present disclosure relates to a zonal isolation device for use during a well workover. In an embodiment, the zonal isolation device may be a bridge plug set using longitudinal movement and hydraulic pressure through the actuation of a hydraulic setting mechanism. The device may be set, unset and reset at another location multiple different times during a single trip into the well bore. In an embodiment, the zonal isolation device may be locked in the set position to avoid inadvertent unsetting. These features allow for the use of a coiled tubing work string and enable well workovers in a single trip into the well bore.

FIG. 1 schematically depicts one representative operating environment for a zonal isolation device 100 that will be more fully described herein. In FIG. 1, the zonal isolation device 100 is employed to provide zonal isolation in a well bore 260 during a downhole operation, such as a well workover. A well bore 260 is shown penetrating a subterranean formation F for the purpose of recovering hydrocarbons. At least the upper portion of the well bore 260 may be lined with casing 255 that is cemented into position against the formation F in a conventional manner. During a workover operation, the zonal isolation device 100 may be deployed on a work string 250 to isolate a zone of interest, as will be more fully discussed below. The workover operation may involve isolating a set of perforations 265 extending into the formation from the well bore 260 below the perforations 265. Multiple zones may be isolated and treated sequentially in order to avoid communication between perforations 265 of different pay zones.

In the embodiment shown in FIG. 1, a representative coiled tubing work string 250 is shown deployed by a coiled tubing system 200 on the surface 205 and suspending the zonal isolation device 100 in the well bore 260. The coiled tubing system 200 may include a power supply 210, a surface processor 220, and a coiled tubing spool 230. An injector head 240 unit feeds and directs the coiled tubing 250 from the spool 230 into the well bore 260. Alternatively, multiple tools may be connected to the end of the coiled tubing work string 250, with the zonal isolation device 100 being the last tool in the tool string.

While the representative well bore conditions depicted in FIG. 1 refer to a zonal isolation device 100 operable for use during a well workover, one of ordinary skill in the art will readily appreciate that the zonal isolation device 100 may also be employed in other applications where pressure or flow isolation is required. For example, the zonal isolation device 100 may be used as a temporary bridge plug during completion operations for production testing of individual zones in a well, or it may be used to shut in a well during well head repairs or maintenance. Further, the zonal isolation device 100 may be used in any type of well bore 260, whether on land or at sea, including deep water well bores; vertical well bores; extended reach well bores; high pressure, high temperature (HPHT) well bores; and highly deviated well bores.

Figure 2A:
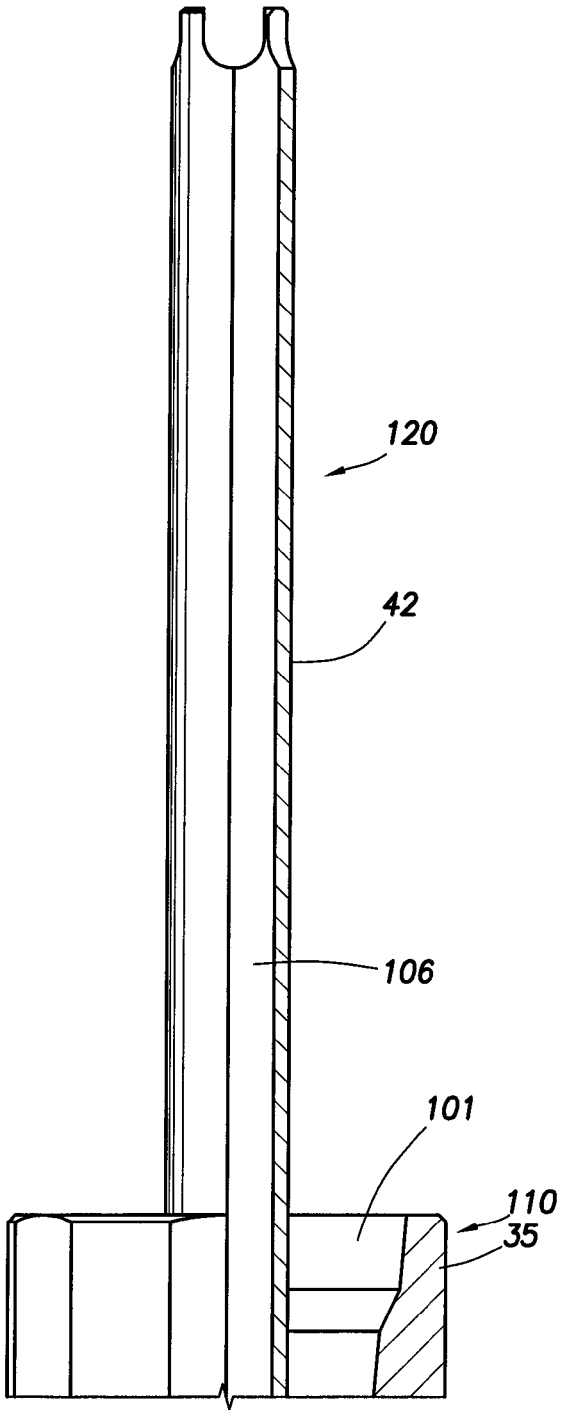
FIGS. 2A through 2N, when viewed sequentially from end-to-end, provide a cross-sectional side view of one embodiment of a zonal isolation device in a run-in configuration.
Figure 2B:
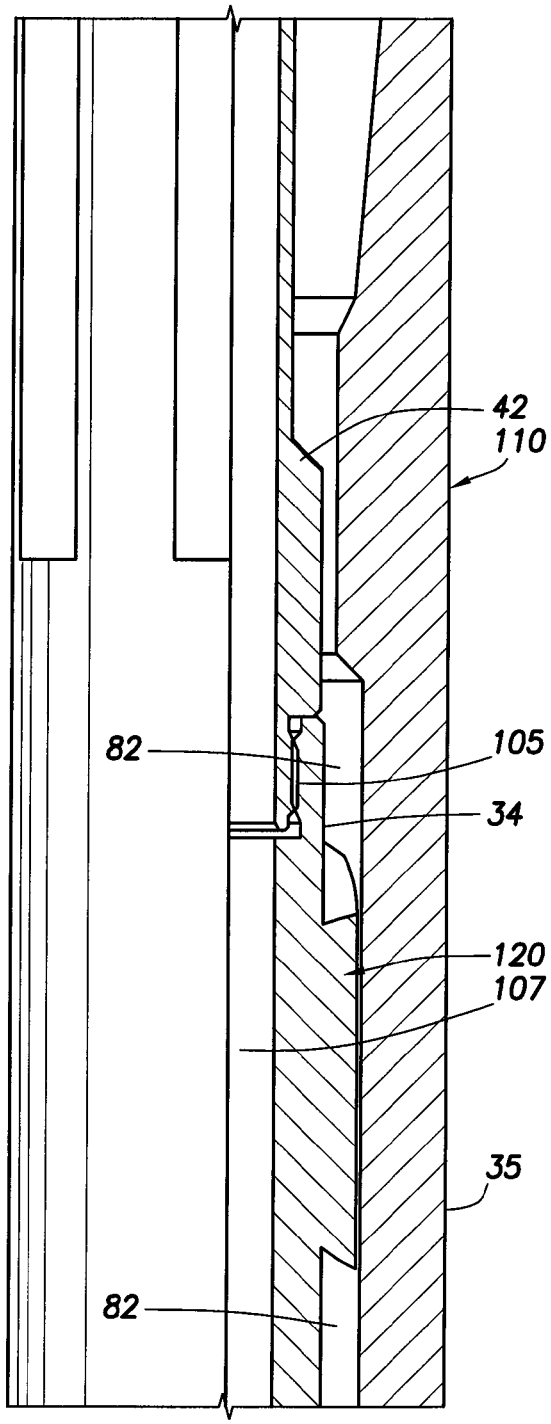
Figure 2C:
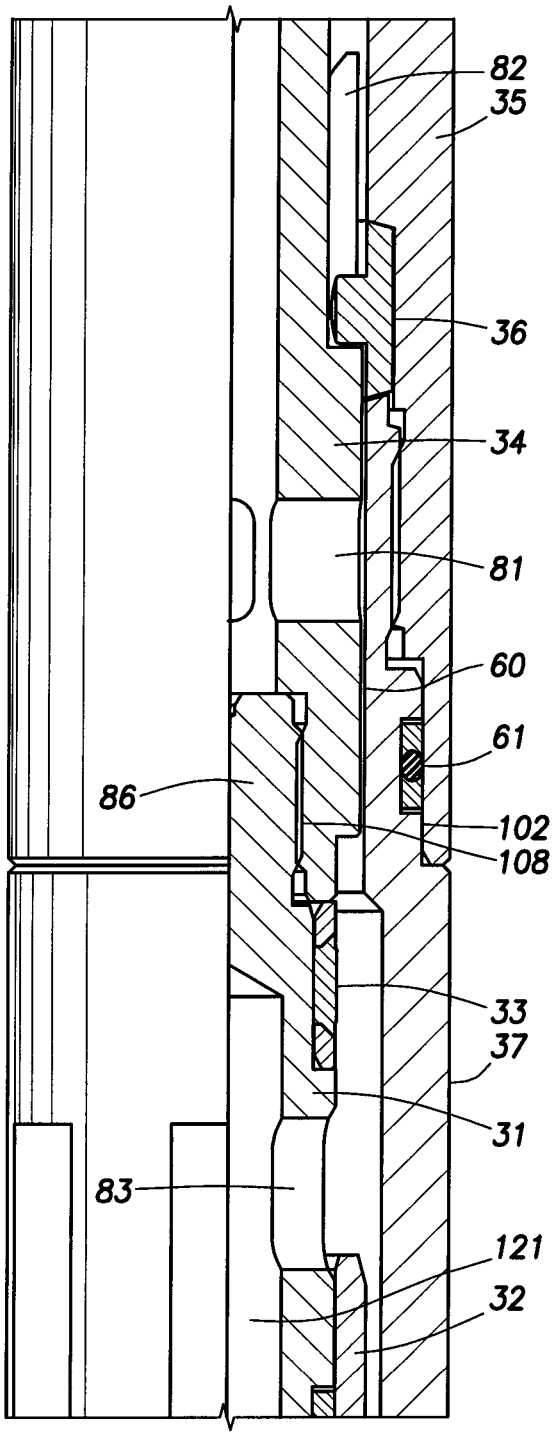

The zonal isolation device 100 may take a variety of different forms. FIGS. 2A through 2N, when viewed sequentially from end to end, depict one embodiment of the zonal isolation device 100 comprising an overshot portion 110, which acts as a coupling device between the coiled tubing 250 or other type of tool string and a retrieving head 120; a packer assembly 130; and a hydraulic setting mechanism 140; the lower portions being supported by mandrels 7, 29 extending internally therethrough. In an embodiment, the mandrels 7, 29 comprise elongated tubular body members having flowbores that allow for fluid to flow from the coiled tubing 250 to the overshot 110, through the packer assembly 130 and to the hydraulic setting mechanism 140. The overshot portion 110 comprises a releasable section that connects the coiled tubing 250 to the retrieving head 120 through the use of a rotating lug 36, which may travel in an upper J-slot 82 as shown in FIG. 2C. The retrieving head 120 may be connected to the packer assembly 130 via an upper mandrel 29 as shown in FIG. 2E, and the upper mandrel 29 runs through the center of the packer assembly 130 where it connects at a lower end to a lower J-slot mandrel 7 as shown in FIG. 2I. The lower J-slot mandrel 7 extends through the hydraulic setting mechanism 140. A slotted case 30 is disposed around the lower J-slot mandrel 7 below the packer assembly 130 and connects the packer assembly 130 to the hydraulic setting mechanism 140 as shown in FIGS. 2I and 2J.

Figure 2D:
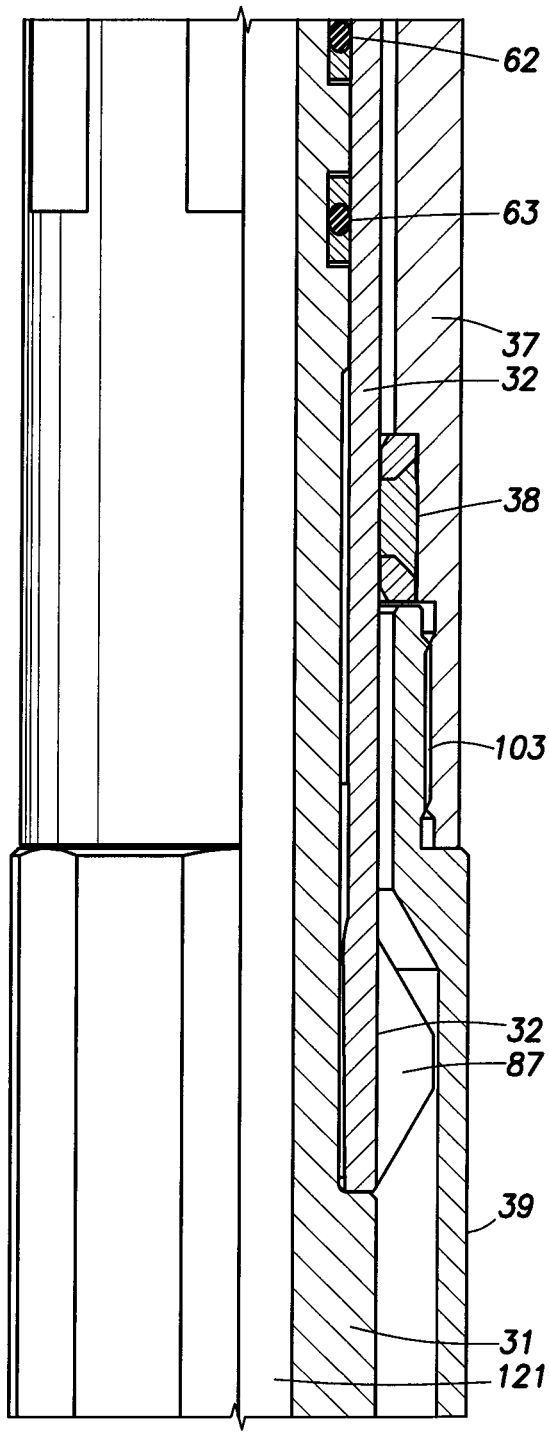
Figure 2E:
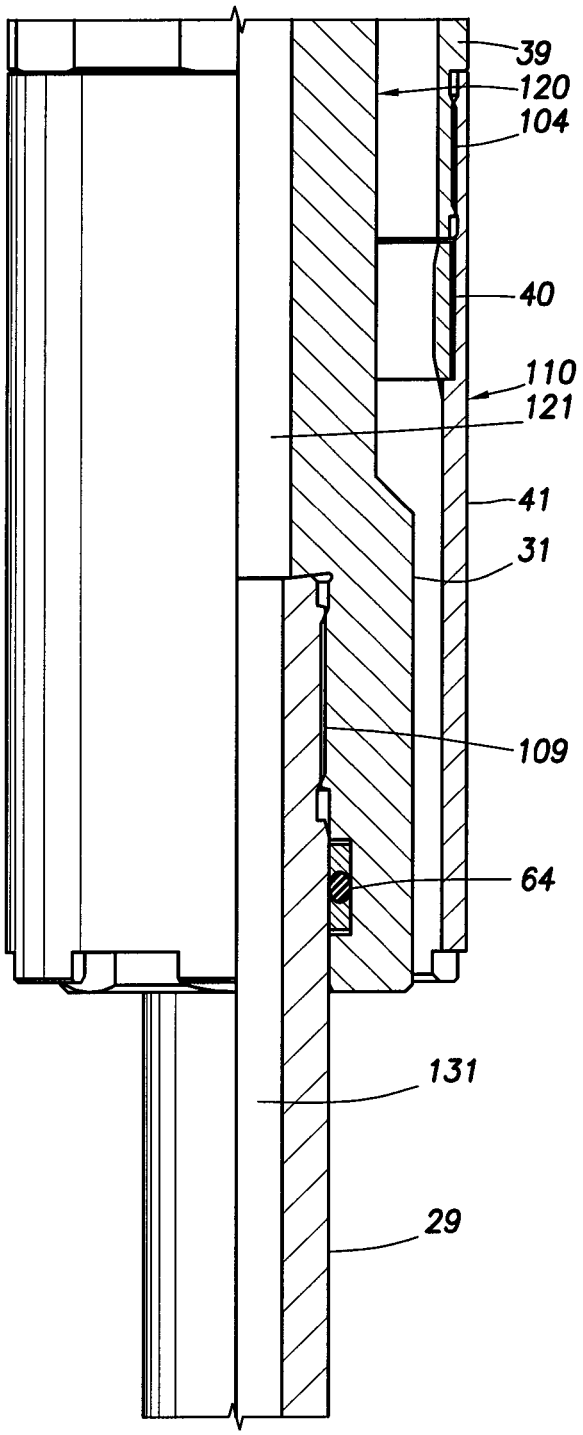
Figure 2F:
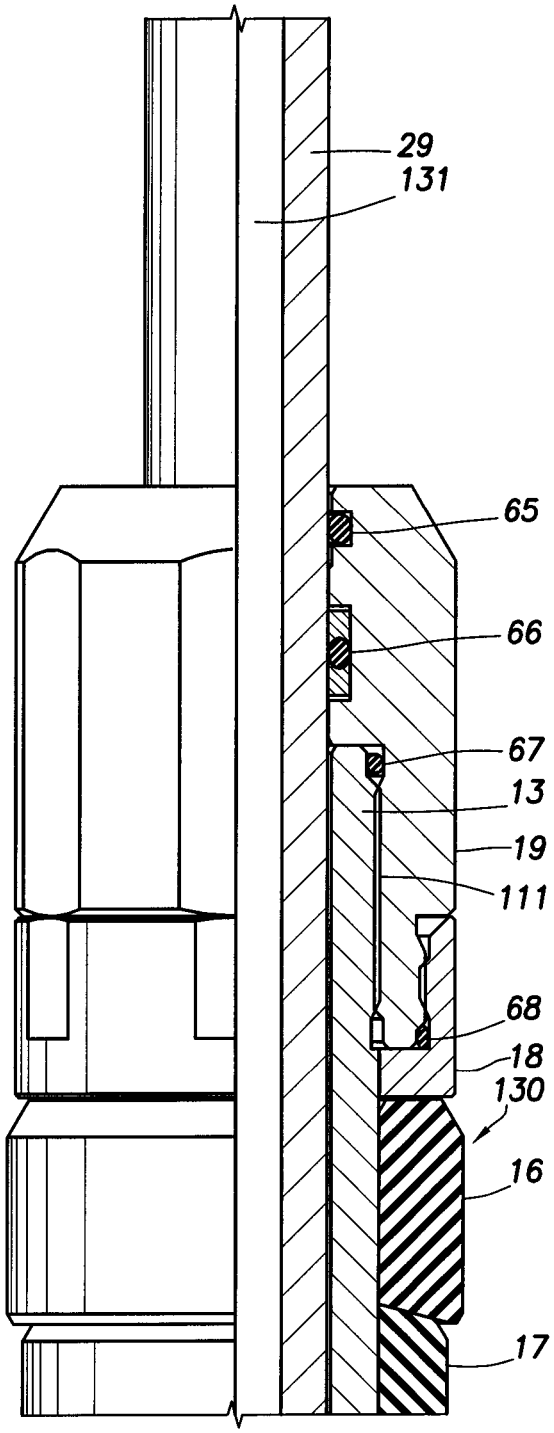

Referring now to FIGS. 2A through 2E, the overshot portion 110 of the zonal isolation device 100 is disposed externally of the retrieving head 120 above the packer assembly 130. The overshot portion 110 is adapted to be releasably connected to the retrieving head 120 and may comprise a ported retrieving head 34, a rotating lug case 35, a bypass case 37, a rotating lug 36, an upper ring spring holder 39, an internal seal 38, a ring spring 40, and a lower ring spring holder 41. As shown in FIG. 2A, the rotating lug case 35 may form an upper box end 101 to enable connection via threads to the lower end of coiled tubing 250 or another tubing string or to the bottom of a tool string upon which the zonal isolation device 100 is lowered into the well bore 260. The rotating lug case 35 may be connected to the rotating lug 36, which may move in the upper J-slot 82 on the ported retrieving head 34, as discussed in more detail below. In an embodiment, the rotating lug case 35 has two rotating lugs 36 located opposite each other circumferentially. The bypass case 37 is connected via threads 102 to the rotating lug case 35 and O-ring seal 61 is provided therebetween as depicted in FIG. 2C. The bypass case 37 supports the internal seal 38, which seals between the bypass case 37 and a balanced valve 32. The upper ring spring holder 39 is connected at its upper end via threads 103 to the bypass case 37 as depicted in FIG. 2D and at its lower end via threads 104 to the lower ring spring holder 41 as depicted in FIG. 2E. The ring spring 40 is connected to the lower ring spring holder 140 where the upper ring spring holder 39 and lower ring spring holders 41 join.

The retrieving head 120 comprises the upper portion of the zonal isolation device 100 that remains in the well bore 260 connected to the packer assembly 130 and hydraulic setting mechanism 140 and provides a releasable connection to the coiled tubing string 250. In the embodiment depicted in FIGS. 2A through 2E, the retrieving head 120 comprises an optional stinger 42, a ported retrieving head 34 comprising a bypass port 81, a bypass body 31 comprising a bypass port 83, and a balanced valve 32. As shown in FIG. 2B, the stinger 42 may be connected via threads 105 to the top of the ported retrieving head 34 and may function to actuate a valve on the lower end of the coiled tubing 250 or tool string upon connection of the overshot 110 to the zonal isolation device 100. In an embodiment in which the stinger 42 is not required to actuate the valve on the bottom of the coiled tubing 250 or tool string, the stinger 42 may not be included as a part of the zonal isolation device 100. A flow path 106 is provided through the center of the stinger 42 that connects to a flow path 107 in the ported retrieving head 34. As shown in FIG. 2C, a bypass port 81 may be provided in the ported retrieving head 34 that functions to route fluid through an annular gap 60 formed between the ported retrieving head 34 and the bypass case 37. The bypass body 31 is connected at its upper end via threads 108 to the ported retrieving head 34 and comprises a solid core 86 at the threaded connection 108 between the two components. The solid core 86 blocks a fluid pathway 121 extending through the interior of the retrieving head 120. A port 83 is provided in the bypass body 31 below the solid core 86 which may receive the fluid flowing through the annular gap 60. The fluid that flows through the annular gap 60 may reenter the fluid pathway 121 of the retrieving head 120 through the port 83 in the bypass body 31. Referring now to FIGS. 2C and 2D, a balanced valve 32, which may comprise a sliding sleeve, forms a sealing and sliding engagement with the bypass body 31 via O-ring seals 62 and 63. The balanced valve 32 may be positioned as shown in FIG. 2C so as to allow fluid to flow through the bypass body port 83, or the balanced valve 32 may be positioned to substantially block the fluid flow through the bypass body port 83. When the balanced valve 32 is positioned to substantially block fluid flow through the bypass body port 83, a sealing engagement is formed between the bypass body 31 and the balanced valve 32 via internal seal 33. As depicted in FIG. 2D, the balanced valve 32 may comprise a balanced valve ring 87 designed to engage the ring spring 40 and actuate the balanced valve 32, as discussed in more detail herein. Referring now to FIG. 2E, the lower end of the bypass body 31 connects to the upper mandrel 29 via threads 109 and seals through O-ring seal 64.

In various embodiments, the O-ring seals in the zonal isolation device 100 may comprise an O-ring bound between two backup seals or may comprise a single O-ring. In various embodiments, the O-rings comprise AFLAS® O-rings with PEEK back-ups for severe downhole environments, Viton O-rings for low temperature service, Nitrile or Hydrogenated Nitrile O-rings for high pressure and temperature service, or a combination thereof. In an embodiment, the zonal isolation device 100 is rated for an operating temperature range of 40 to 450 degrees Fahrenheit.

Figure 3:
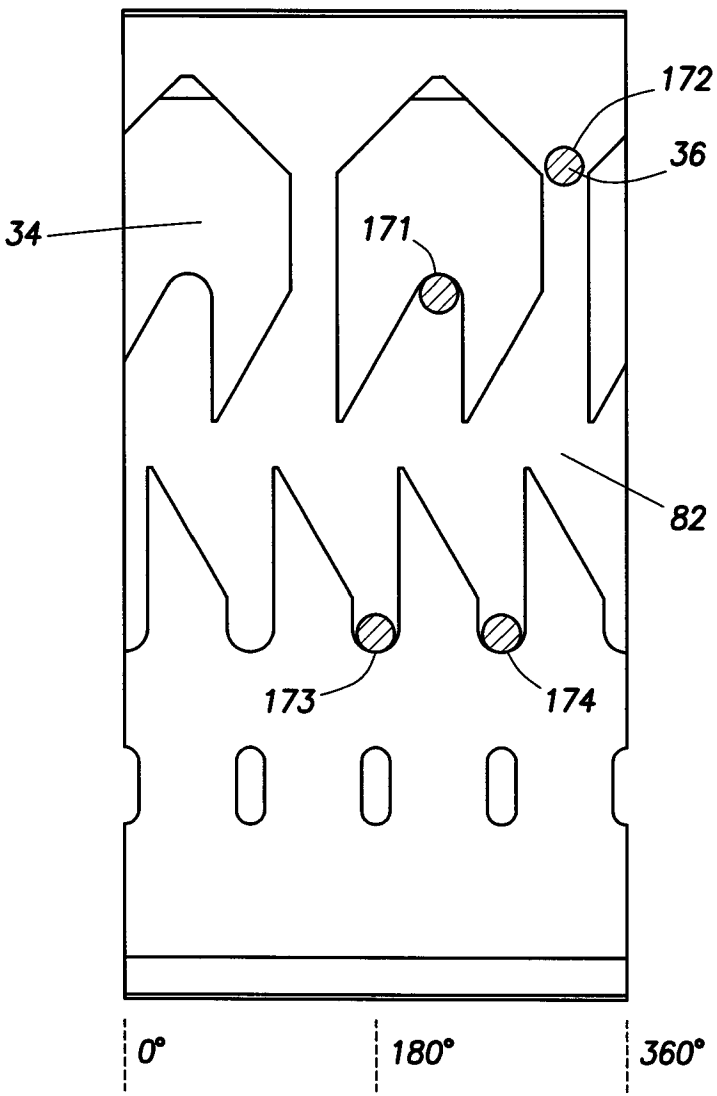
FIG. 3 illustrates the retrieving head J-slot angular positions with rotator lug positions for the zonal isolation device of FIGS. 2A through 2N.

Referring now to FIGS. 2B, 2C, and 3, the upper J-slot 82 in the ported retrieving head 34 may be a continuous J-slot, which refers to a design in which the J-slot continues around the entire outer perimeter of the ported retrieving head 34, and the rotating lug 36 may be rotated around the ported retrieving head 34. The upper J-slot 82 is a groove in the ported retrieving head 34 in which the rotating lug 36 may slide. The position of the upper J-slot 82 is determined by the rotational position of the rotating lug 36 due to a design in which the upper J-slot 82 has angles that rotate the rotating lug 36 as the overshot 110 longitudinally cycles. As used herein, a longitudinal cycle refers to a downward movement followed by an upward movement. In an embodiment, the upper J-slot 82 may have several possible rotating lug 36 positions. Two possible positions may be a connected position and a releasable position. Referring to FIG. 3, in an embodiment, the connected position is shown by rotating lug position 171 and may be one of the possible run-in positions. When the rotator lug 36 is engaged in this position, the overshot 110 may not be released from the retrieving head 120, which may prevent inadvertent disconnection during setting. From this position, the rotator lug 36 may rotate to location 172 in response to a cycling of the overshot 110. In an embodiment, the overshot 110 may require from 1 to 6 cycles to move into the releasable rotator lug position 172 which may allow the overshot 110 to release from the retrieving head 120. Upon retrieval of the zonal isolation device 100, the overshot 110 may start in the releasable position 172 as well. In between the connected position 171 and the releasable position 172 may be intermediate cycling positions 173 and 174. Intermediate position 173 results from a partial cycling of the overshot 110 wherein the overshot 110 starts in the releasable position 172. This action may occur when weight is set down upon the zonal isolation device 100 during retrieval. Intermediate position 174 may result from a cycling of the overshot 110 when the overshot 110 starts in the connected position 171. This may occur when weight is set down after setting to release the overshot 110 so that a workover may be performed higher in the well bore.

Referring now to FIGS. 2F through 2J, the packer assembly 130 is positioned radially externally of the upper mandrel 29 and longitudinally between the retrieving head 120 and the hydraulic setting mechanism 140. In an embodiment, the packer assembly 130 comprises an upper body 19, one or more resilient sealing elements 16, 17, an upper wedge 14, upper slips 70, lower slips 71, a lower wedge 25, a ratchet 27, a ratchet mandrel 13, an alignment bolt 26, and shear screws 49. The upper mandrel 29 forms a sealing, sliding engagement with the upper body 19 via O-ring seals 65 and 66. The upper body 19 connects via threads 111 to the ratchet mandrel 13 and forms a sealing engagement via O-ring seal 67. The upper mandrel 29 extends through the center of the packer assembly 130 allowing for fluid flow therethrough via flowbore 131. On the lower portion of the packer assembly 130 shown in FIG. 2I, the upper mandrel 29 connects via threads 112 to the lower J-slot mandrel 7, which provides a continuous fluid flow path through the packer assembly 130 to the hydraulic setting mechanism 140. The connection between the upper mandrel 29 and the lower J-slot mandrel 7 is sealed via O-ring seal 76. The lower wedge 25 is connected via threads 113 to the slotted case 30, which is connected to the hydraulic setting mechanism 140 via threads 114 as shown in FIG. 2K.

In an embodiment, the packer assembly 130 comprises three resilient sealing elements 16, 17 with a soft center element 17 formed of 70 durometer nitrile and two harder end elements 16 formed of 90 durometer nitrile. In an embodiment, the harder end elements 16 provide an extrusion barrier for the softer center element 17, and the multi-durometer resilient sealing elements 16, 17 seal effectively in high and low pressure applications, as well as in situations where casing wear is more evident in the zonal isolation device 100 setting area. An upper element support shoe 18 shown in FIG. 2F and a lower element support shoe 15 shown in FIG. 2G enclose the resilient sealing elements 16, 17 at the upper and lower ends, respectively, and provide anti-extrusion back up to the resilient sealing elements 16, 17. The upper support shoe 18 is sealingly engaged to the upper body 19 via O-ring seal 68, and the lower support shoe 15 is sealingly engaged to the upper wedge 14 via O-ring seal 69. In an embodiment, the upper 18 and lower 15 element support shoes comprise yellow brass.

Figure 2G:
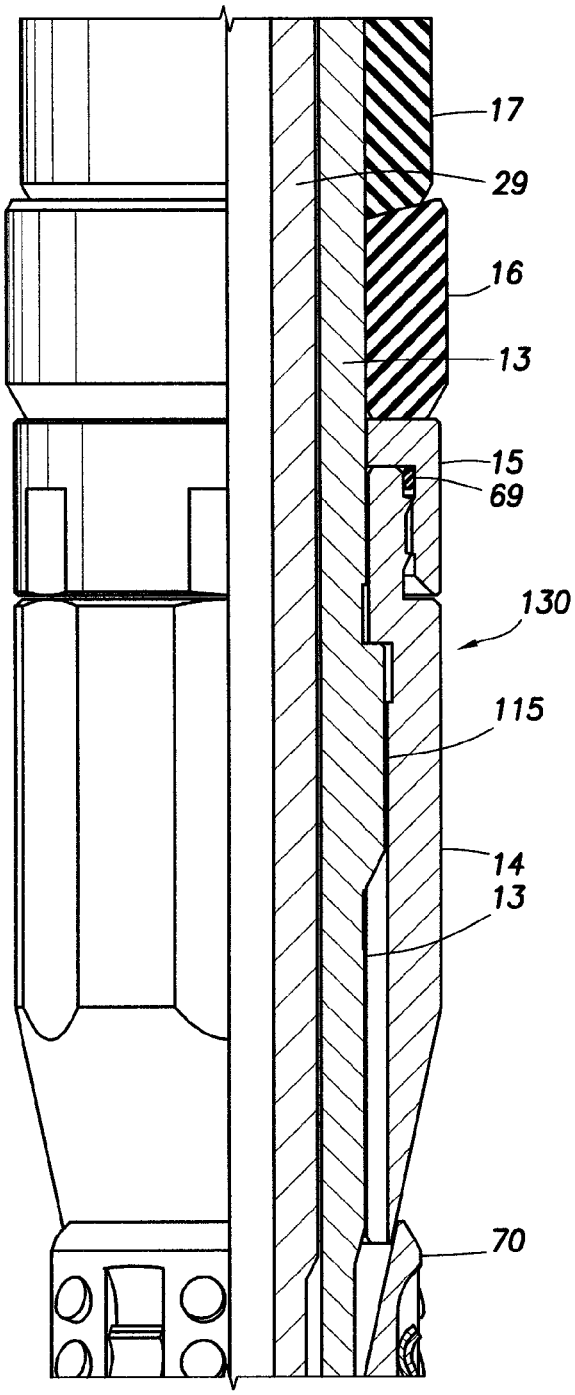
Figure 2H:
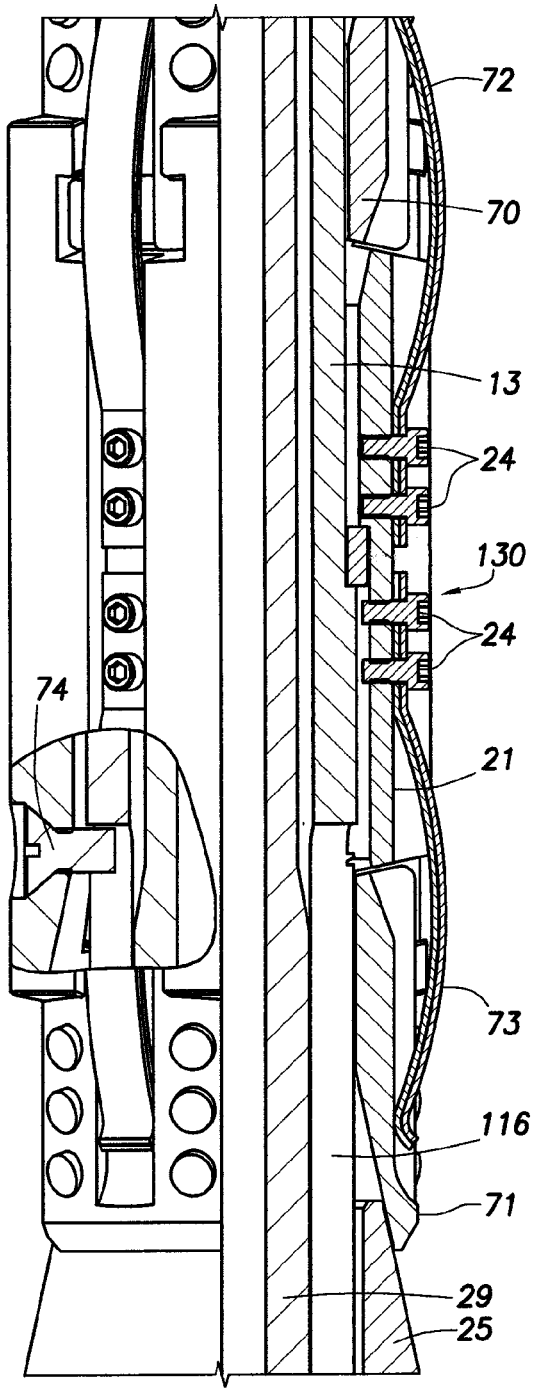
Figure 2I:
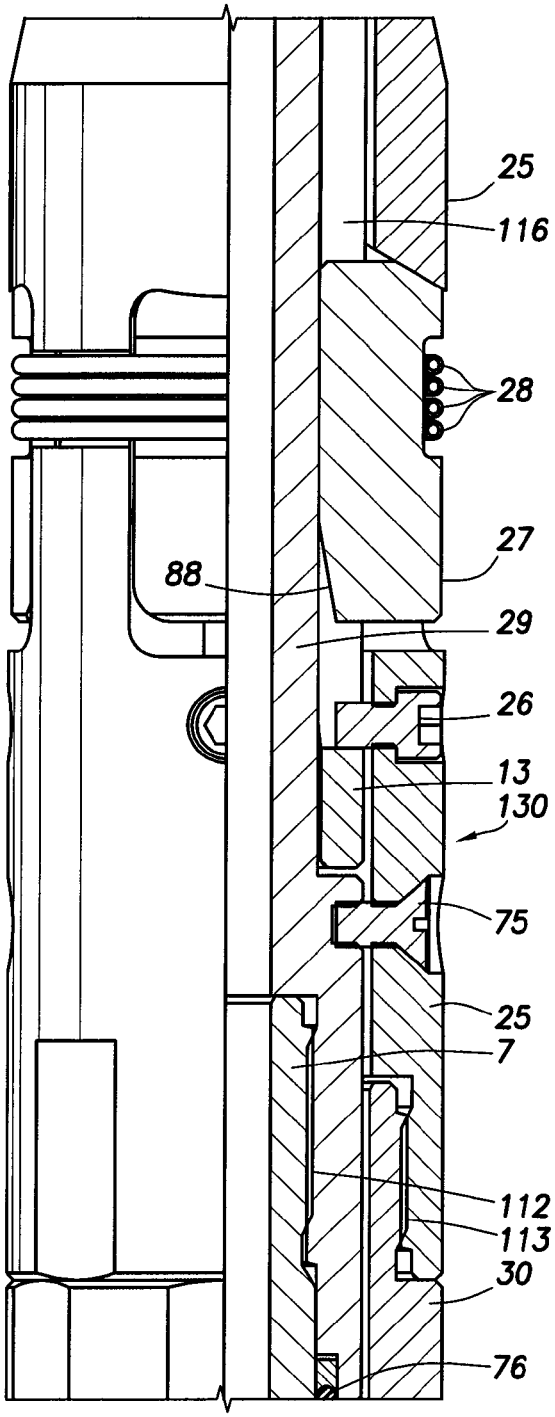
Figure 2J:
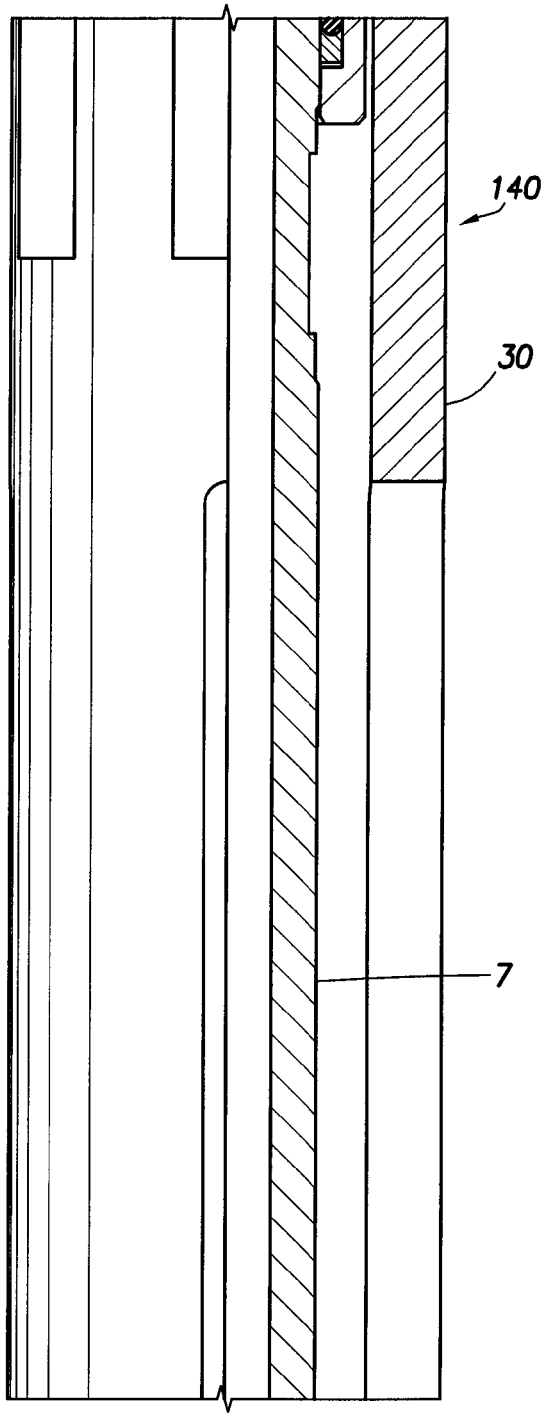
Figure 2K:
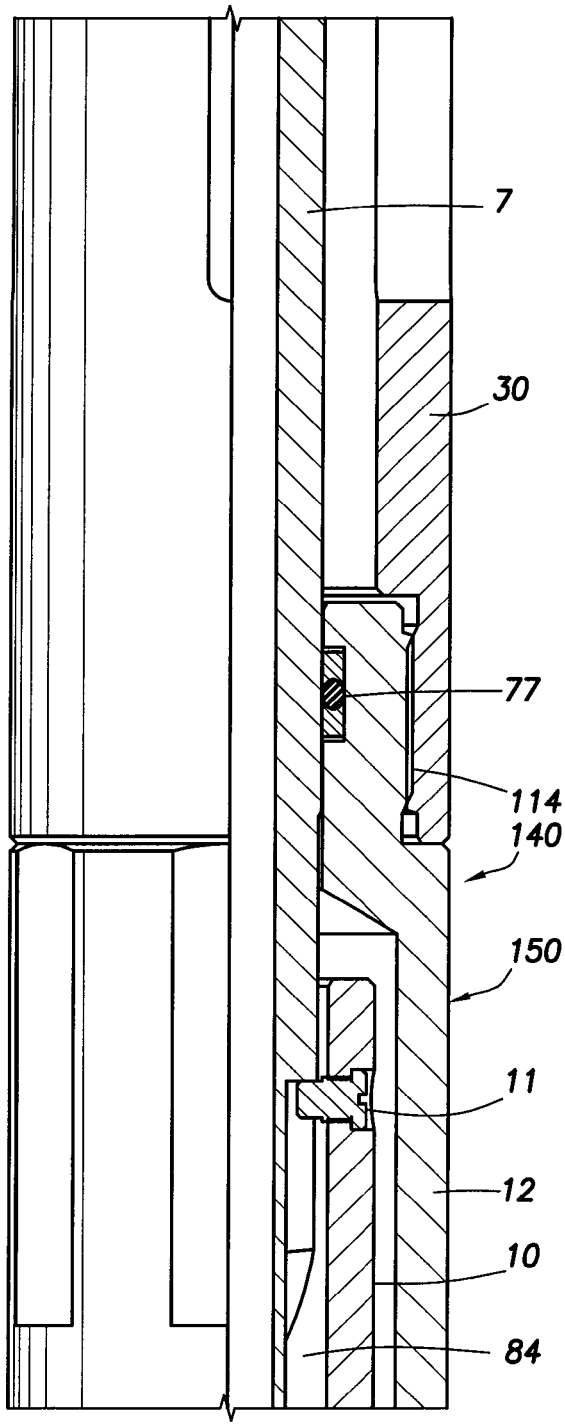

Referring now to FIGS. 2G and 2H, in an embodiment, the upper and lower slips 70, 71 are disposed about the upper mandrel 29 below the resilient sealing elements 16, 17. The upper slips 70 form a sliding engagement with the ratchet mandrel 13, which further forms a sliding engagement with the upper mandrel 29. The upper wedge 14 is disposed above the upper slips 70 and forms a threaded connection 115 with the ratchet mandrel 13. The lower slips 71 form a sliding engagement with ratchet mandrel 13 and form a sliding engagement with the lower wedge 25. As shown in FIG. 2I, the lower wedge 25 is aligned with the upper mandrel 29 through an alignment bolt 26 and is initially held in place via shear screw 75. As shown in FIG. 2H, the slips 70, 71 are biased into a closed position when not actuated by the upper wedge 14 or lower wedge 25, respectively, due to slip retaining springs 72, 73 which are connected to a slip body 21 by set screws 24. Initially, the slip body 21 is connected to the ratchet mandrel 13 and held in place by shear screw 74.

In an embodiment, the slips 70, 71 comprise C-ring slips manufactured from low yield AISI grade carbon steel to allow for easier milling. In an embodiment, the slips 70, 71 may also be case-carburized with a surface-hardening treatment to provide a hard tooth surface operable to bite into high yield strength casing. The slips 70, 71 may be present in any number sufficient to secure the zonal isolation device 100 to the casing. In an embodiment, there may from 1 to 4 slips for each of the upper 70 and lower 71 slip elements. Alternatively, only one set of slip elements 70, 71 may be present in a number ranging from 1 to 4 slips.

Figure 4:
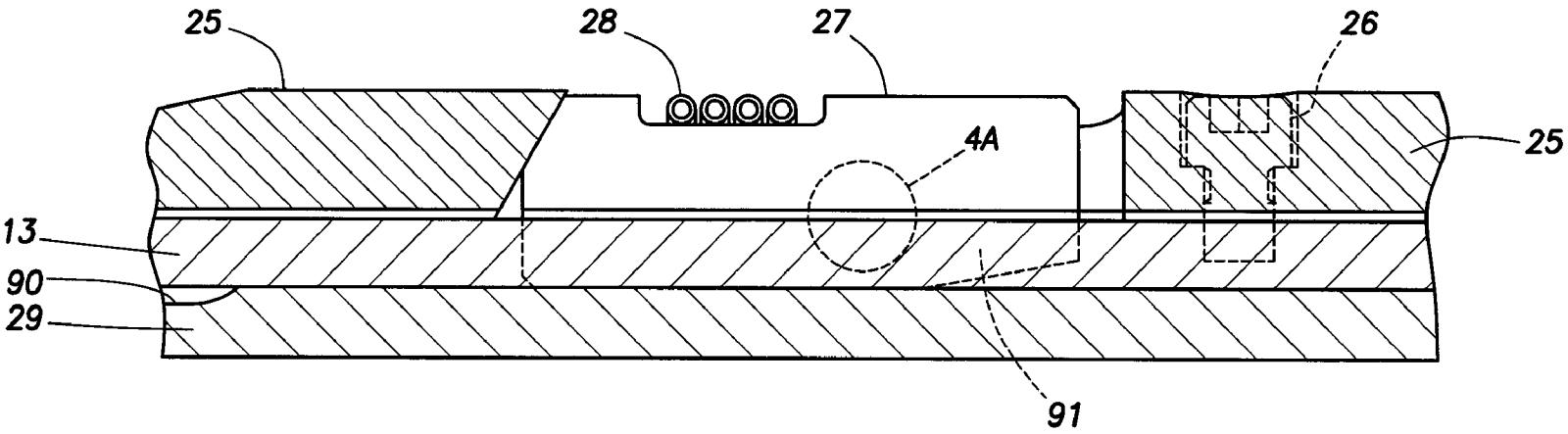
FIG. 4 illustrates a detailed view of the ratchet, the ratchet mandrel, and the interlocking ratchet teeth thereof for the zonal isolation device of FIGS. 2A through 2N.
Figure 4A:
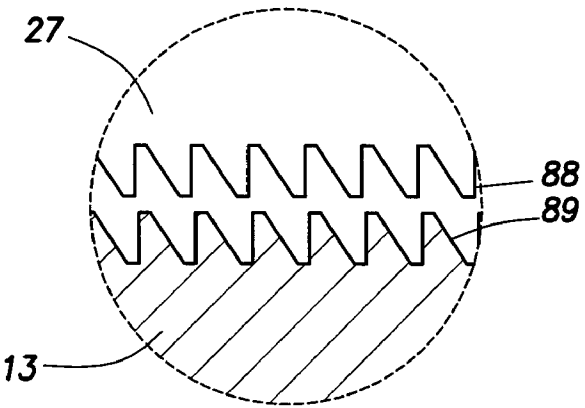
FIG. 4A provides an enlarged cross-sectional side view of the interlocking ratchet teeth depicted in FIG. 4.

Referring now to FIGS. 2F through 2J, FIG. 4 and FIG. 4A, a ratchet 27 shown in FIG. 2I is positioned below the slips 70, 71 to secure the slips 70, 71 and resilient sealing elements 16, 17 in place once actuated. The ratchet 27 forms a sliding engagement with the upper mandrel 29 and is located in a slot 116 that extends through the lower wedge 25 and the ratchet mandrel 13. The ratchet 27 is held in place by a ratchet spring 28 disposed about the lower wedge 25 and ratchet 27. In an embodiment, the ratchet spring 28 may be a ring spring. As best shown in FIG. 4A, the ratchet 27 comprises a plurality of angled teeth 88 that engage and interact with a corresponding saw-tooth profile 89 on the ratchet mandrel 13. Such a saw-tooth profile is also commonly referred to as a "phonograph finish" or a "wicker". The ratchet 27 comprises an inner portion 91 that forms a sliding engagement with the upper mandrel 29. The upper mandrel 29 comprises a section with a depression 90 that may align with the inner portion 91 depicted in FIG. 4 of the ratchet 27 during setting, allowing the ratchet 27 to fall inward and engage the ratchet mandrel 13 due to the force of the ratchet spring 28. Once engaged, the ratchet 27 may move in a direction that actuates the packer assembly 130 but may be substantially prevented from movement in the opposite direction. Through the interaction of the angled teeth 88 on the ratchet 27 and the saw-tooth profile 89 on the ratchet mandrel 13, the ratchet 27 and the ratchet mandrel 13 are designed to provide resistance to unsetting once actuated, as will be more fully described herein.

Figure 2L:
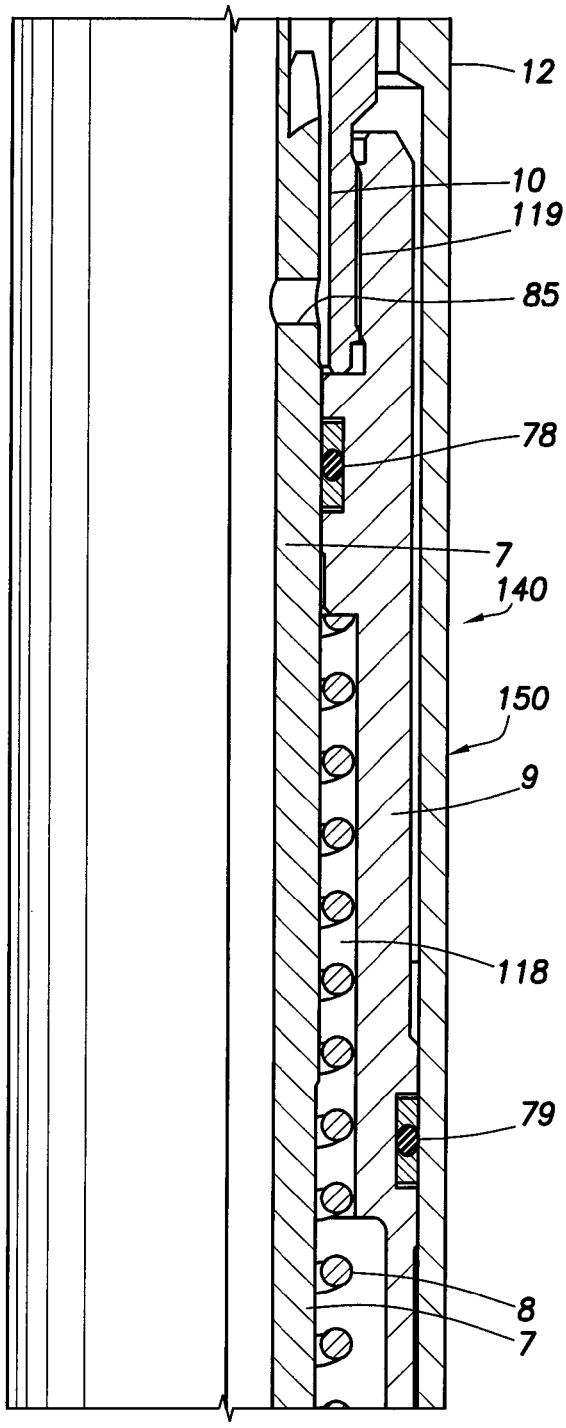
Figure 2M:
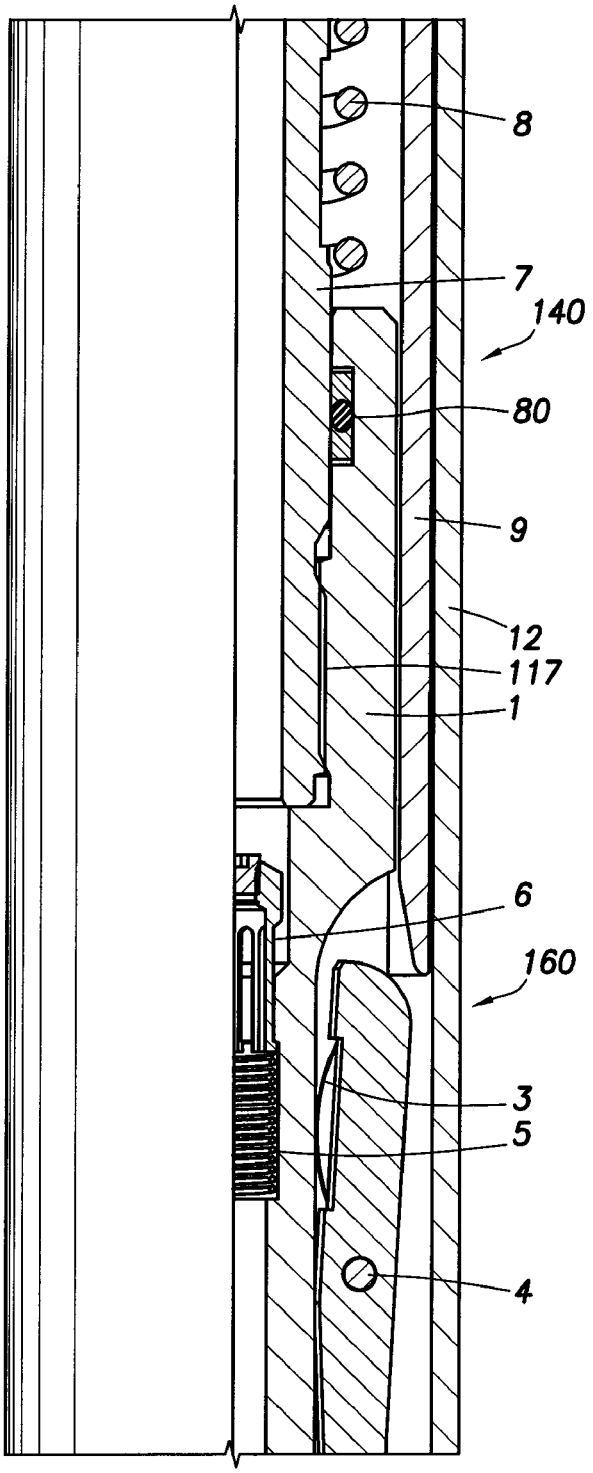
Figure 2N:
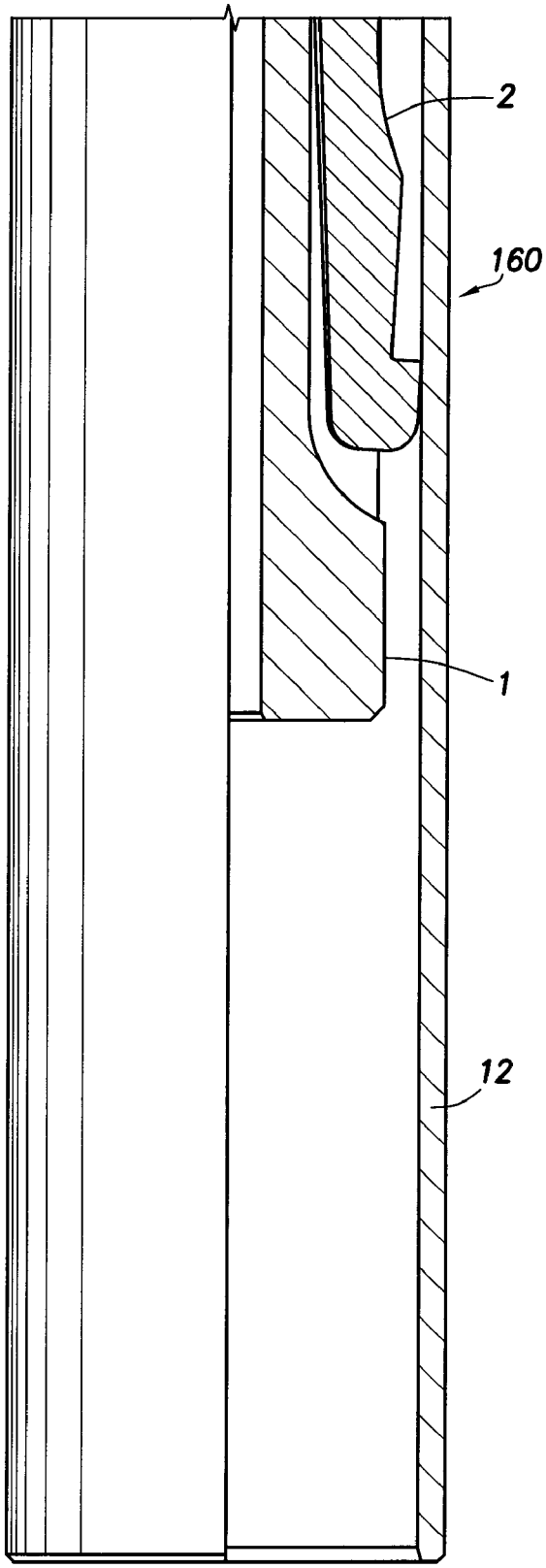

Referring now to FIGS. 2J through 2N, the hydraulic setting mechanism 140 is positioned longitudinally below the packer assembly 130 to prevent any debris or sand from interfering with its operation. The hydraulic setting mechanism 140 comprises a piston portion 150 further comprising the lower J-slot mandrel 7, a piston case 12, a piston spring 8, and a piston 9; and a locking mechanism portion 160 further comprising a bottom lug body 10, a lock body 1, a locking arm 2, and a velocity check valve 6, held in an open position by biasing spring 5. The lower J-slot mandrel 7 extends longitudinally through the hydraulic setting mechanism 140 and connects via threads 117 to the lock body 1 at the bottom of the hydraulic setting mechanism 140 and an O-ring seal 80 is provided therebetween as shown in FIG. 2M. The slotted case 30 connects via threads 114 to the piston case 12, which is disposed externally of the lower J-slot mandrel 7 as shown in FIG. 2K.

Referring now to FIGS. 2K through 2M, in an embodiment, the piston portion 150 of the hydraulic setting mechanism 140 comprises the piston case 12, the piston 9, and the piston spring 8. The piston case 12 is disposed externally about the lower J-slot mandrel 7 and is connected via threads 114 to the slotted case 30 on the upper end. The piston case 12 forms a sealing, sliding engagement with the lower J-slot mandrel 7 below the slotted case 30 through the use of O-ring seal 77 as shown in FIG. 2K. Referring to FIG. 2L, the piston 9 is disposed between the piston case 12 and the lower J-slot mandrel 7 and forms a sealing, sliding engagement with both the piston case 12 and the lower J-slot mandrel 7 via O-ring seals 79 and 78, respectively. A piston spring 8 is disposed in a chamber 118 between the piston 9 and the lower J-slot mandrel 7 beginning at a point below O-ring seal 78. As shown in FIGS. 2K and 2L, the piston 9 is coupled to the lower J-slot mandrel 7 by a lower J-slot pin 11 that moves through a lower J-slot 84 disposed on the outer surface of the lower J-slot mandrel 7 between O-ring seals 77 and 78. As shown in FIG. 2L, a bottom lug body 10 is connected to the piston 9 via threads 119 and supports the lower J-slot pin 11 that moves through the lower J-slot 84 in response to various longitudinal movements, as described more fully herein. In an embodiment, the bottom lug body 10 has two lower J-slot pins 11 located circumferentially opposite each other. The lower J-slot mandrel 7 also has a port 85 between the J-slot 84 and O-ring seal 78. The port 85 functions to convey fluid and fluid pressure to the top of the piston 9 once a velocity check valve 6 depicted in FIG. 2M has blocked fluid flow through the bottom of the zonal isolation device 100.

Figure 5:
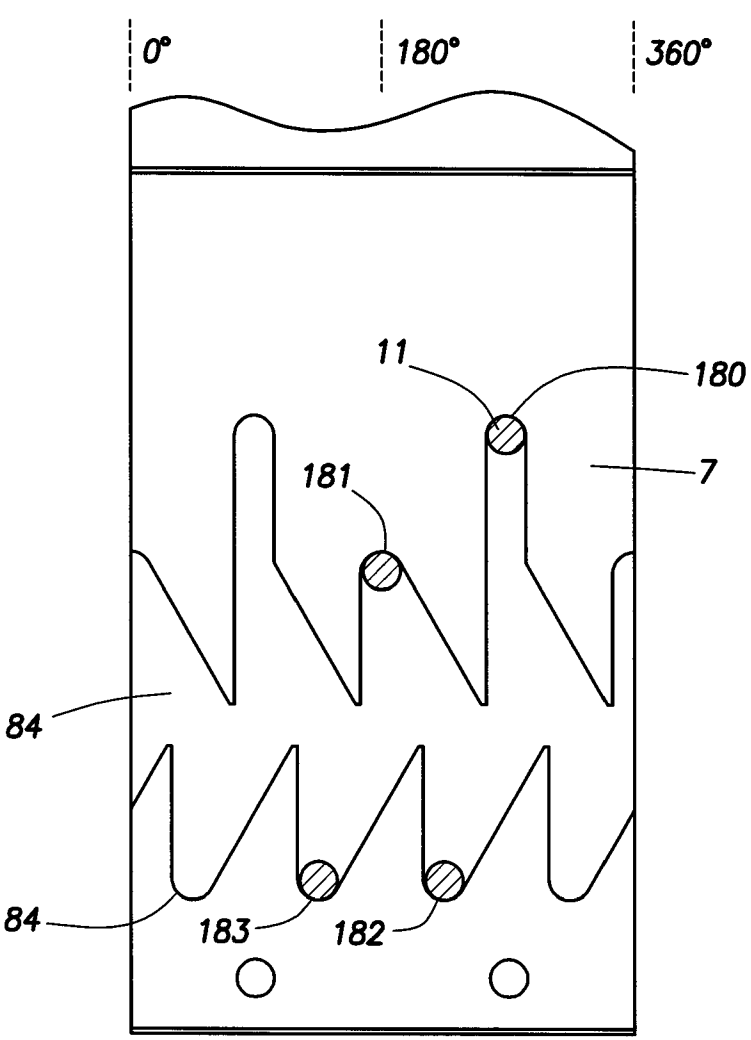
FIG. 5 illustrates the lower J-slot angular positions with lower J-slot pin positions for the zonal isolation device of FIGS. 2A through 2N.

In an embodiment depicted in FIGS. 2K, 2L and 5, as with the upper J-slot 82, the lower J-slot 84 may be a continuous J-slot, which refers to a design in which several lower J-slot pin 11 positions are possible corresponding to the actuated state of the hydraulic setting mechanism 140. The lower J-slot 84 is a grove in the lower J-slot mandrel 7 in which the lower J-slot pin 11 may slide in response to a longitudinal force. The lower J-slot pin 11 may prevent the lower J-slot mandrel 7 from moving beyond the range allowed by the J-slot 84 due to the physical interaction between the lower J-slot pin 11 with the edge of the lower J-slot 84. The actuated state of the hydraulic setting mechanism 140 is determined by the rotational position of the lower J-slot pin 11, which rotates due to angles in the lower J-slot 84 that rotate the lower J-slot pin 11 as the piston 9 longitudinally cycles. The lower J-slot 84 may have several positions depending on the number of actuated states required for the zonal isolation device 100. In an embodiment, the lower J-slot 84 may have two positions. The first position may be the unactuated position 180 shown in FIG. 5. This position represents the run-in position for the zonal isolation device 100. From this position, the lower J-slot pin 11 may rotate through location 182 to location 181 in response to a cycling of the piston 9. Location 182 results from a partial cycling of the piston 9 and represents the lower J-slot pin 11 location during actuation of the piston 9 to set and lock the zonal isolation device 100. Once the pressure has been released after setting, the lower J-slot pin 11 may be in an actuated position in which the lower J-slot pin 11 may prevent the piston 9 from moving up and allowing the locking arm 2 to disengage. While the zonal isolation device 100 is in an actuated position, the lower J-slot pin 11 is held in this position by the applied force of the piston spring 8. Upon a further cycling, the lower J-slot pin 11 may move through location 183 into the unactuated position 180, which may return the hydraulic setting mechanism 140 to an unlocked state by allowing the piston 9 to rise and disengage the locking arm 2.

Returning to FIGS. 2M and 2N, the locking mechanism 160 prevents further movement of the lower J-slot mandrel 7, once actuated, until the hydraulic setting mechanism 140 is unlocked. In an embodiment, the locking mechanism 160 comprises a lock body 1, the locking arm 2, a lock pin 4, and a lock spring 3. The lock body 1 has an upper portion that extends between the piston 9 and the lower J-slot mandrel 7 and forms a sealing engagement with the lower J-slot mandrel 7 via O-ring seal 80. This portion of the lock body 1 may act as a lower support for the piston spring 8. The locking arm 2 is connected to the lock body 1 by the lock pin 4 about which the locking arm 2 rotates. The lock spring 3 is disposed between the upper portion of the locking arm 2 and the lock body 1 so as to bias the locking arm 2 above the lock pin 4 outwards towards the piston case 12. The velocity check valve 6 is disposed within the lock body 1 via threads and acts to control the pressure within the zonal isolation device 100. The velocity check valve 6 may be designed to remain open due to the biasing force of spring 5 until a set point flow rate is achieved. In an embodiment, the set point flow rate may be about 0.5 barrels per minute.

Figure 6A:
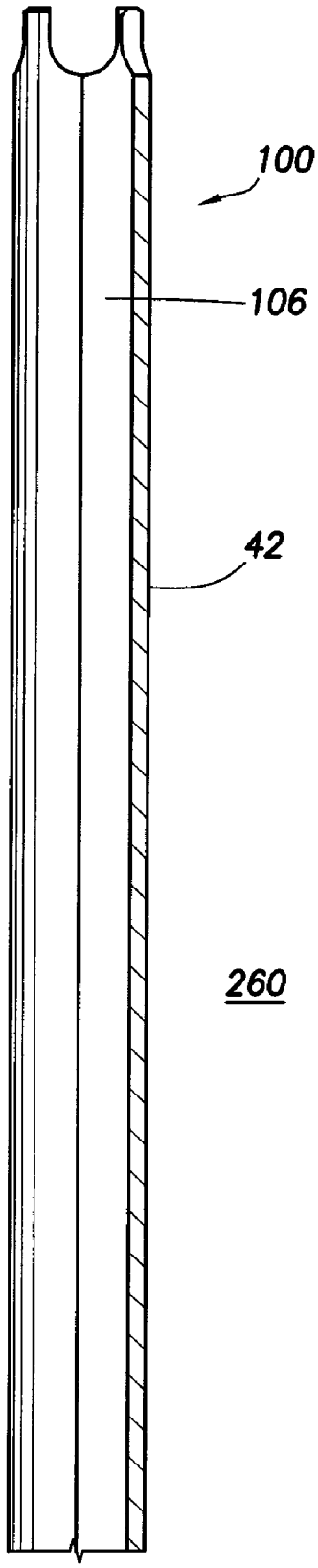
FIGS. 6A through 6N, when viewed sequentially from end-to-end, provide a cross-sectional side view of one embodiment of a zonal isolation device in a set and locked configuration.
Figure 6B:
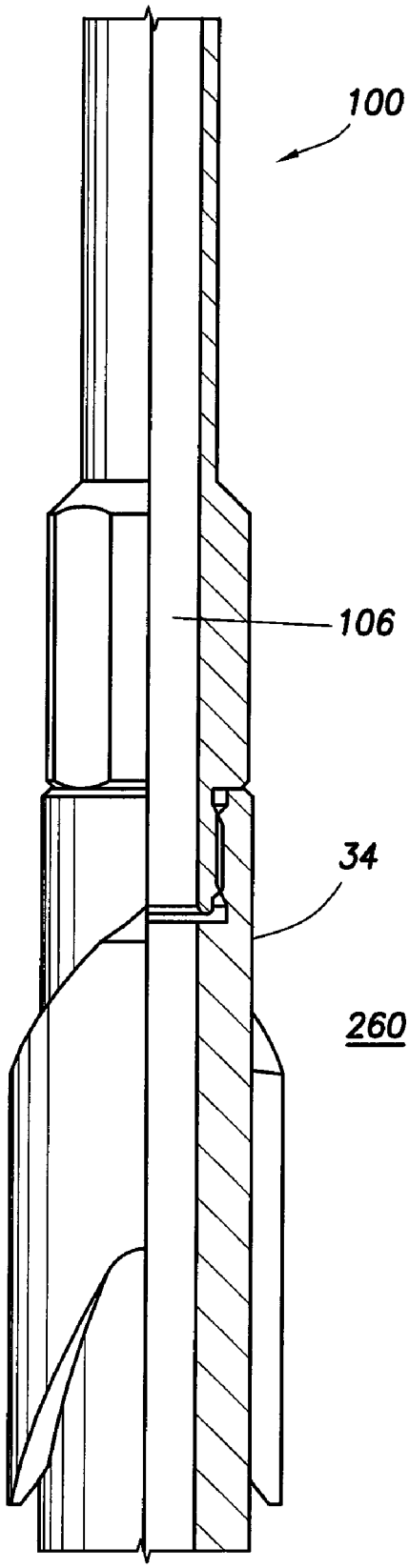
Figure 6C:
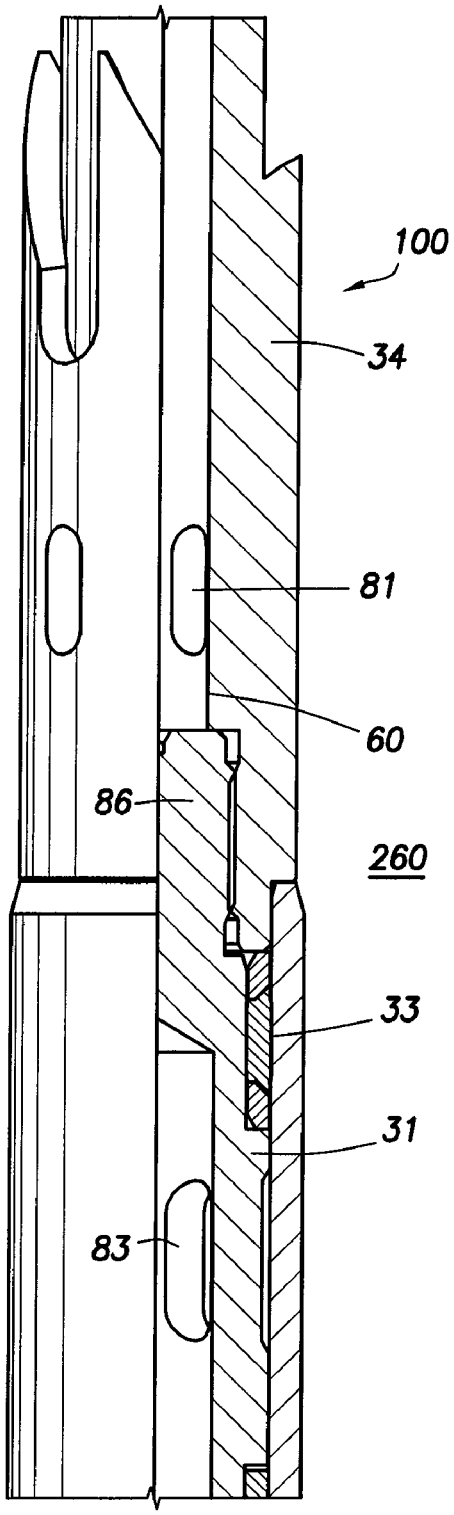
Figure 6D:
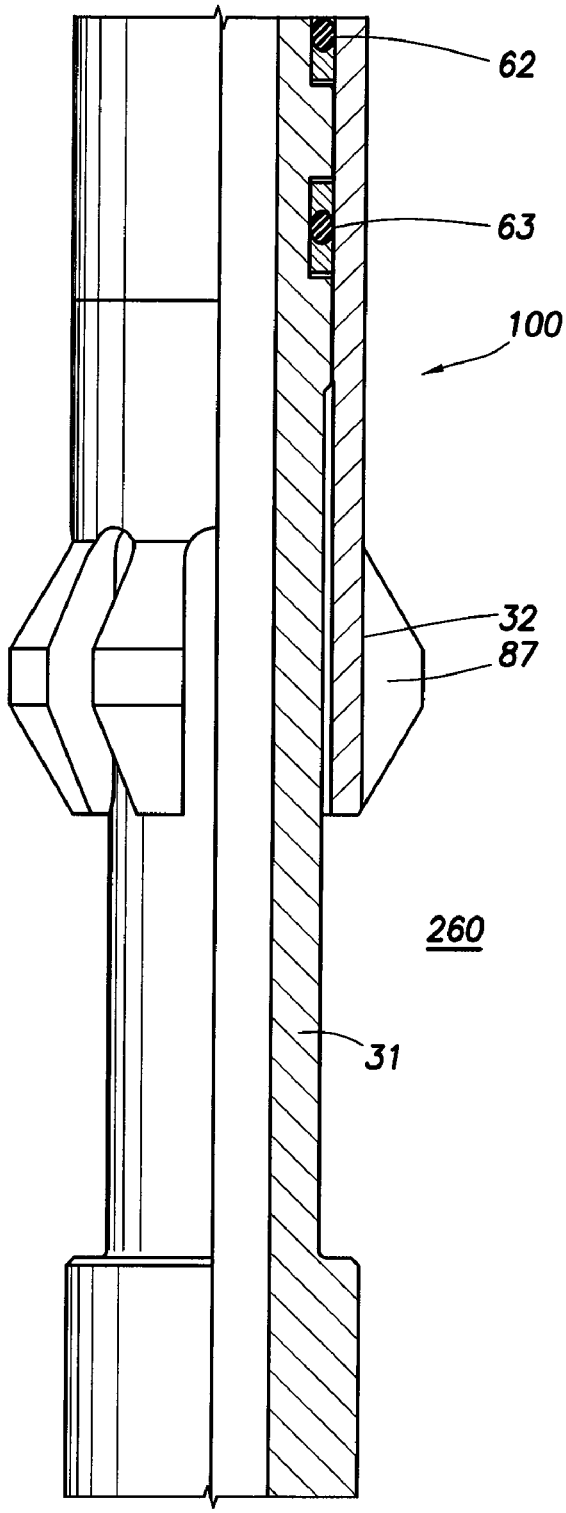
Figure 6E:
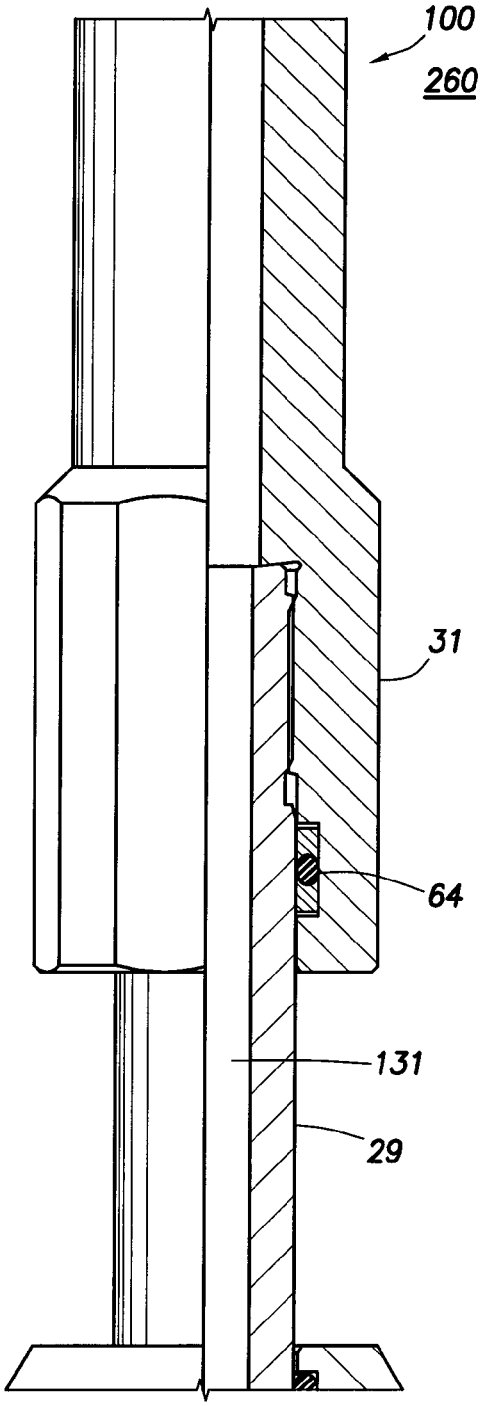
Figure 6F:
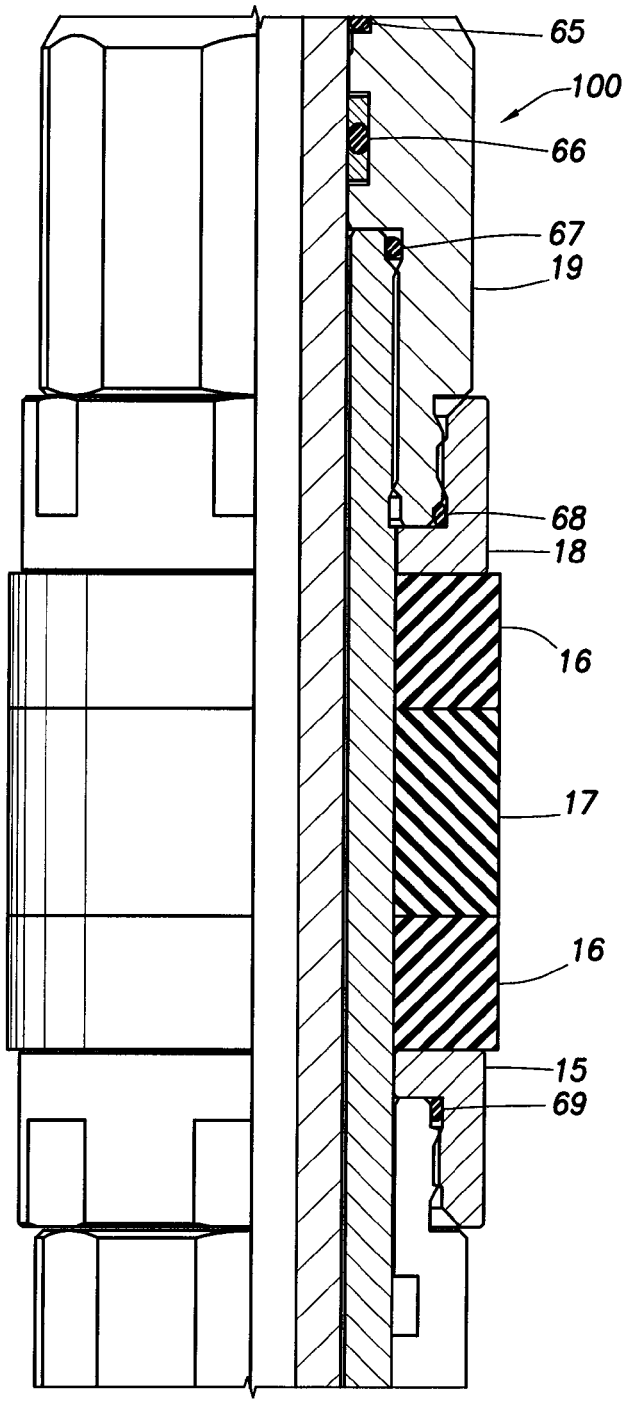
Figure 6G:
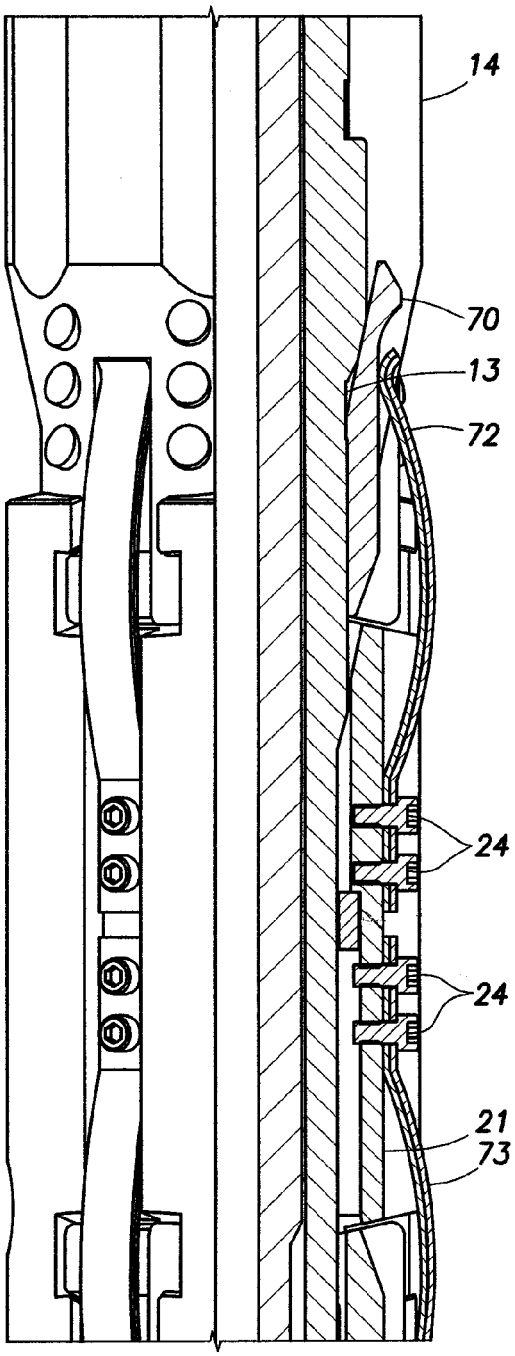
Figure 6H:
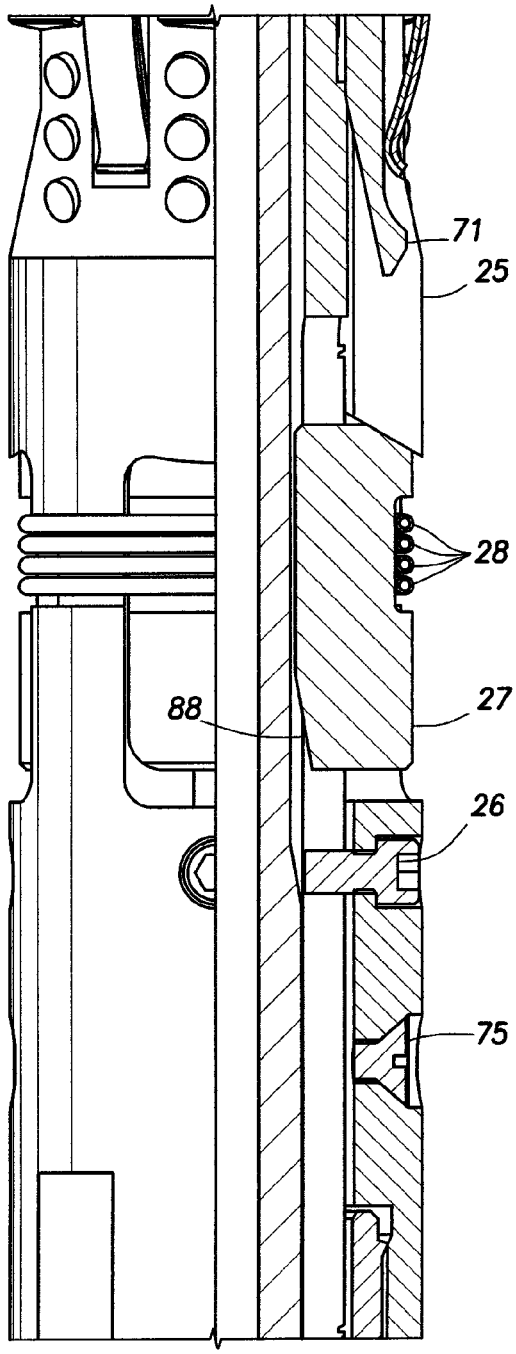
Figure 6I:
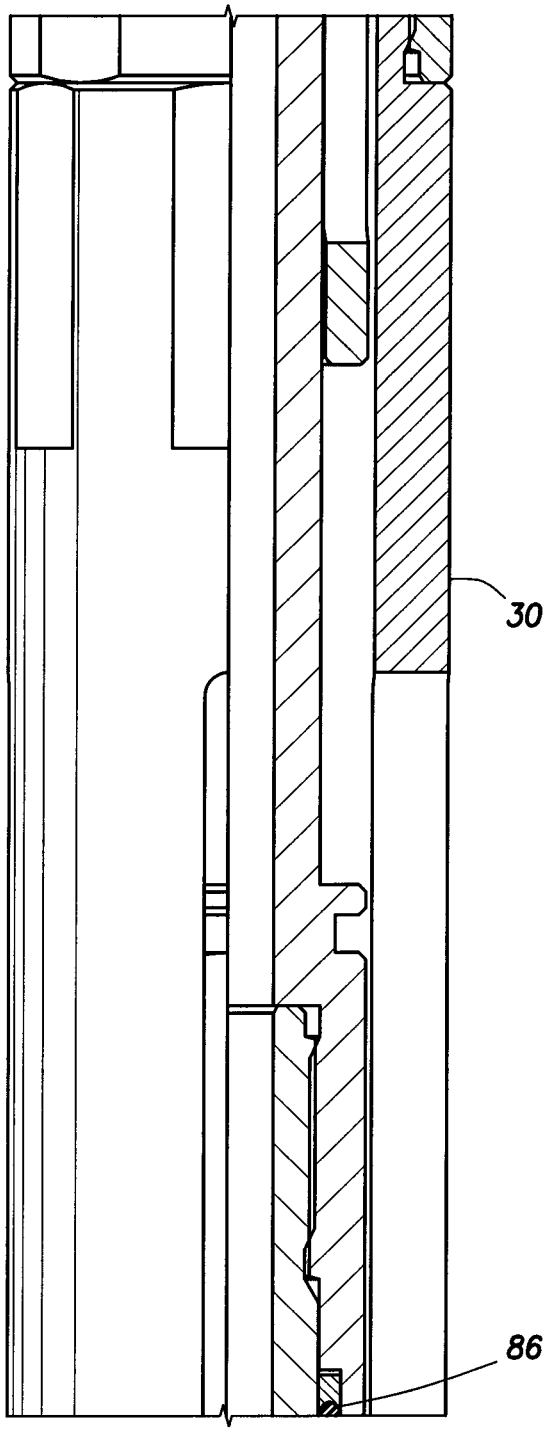
Figure 6J:
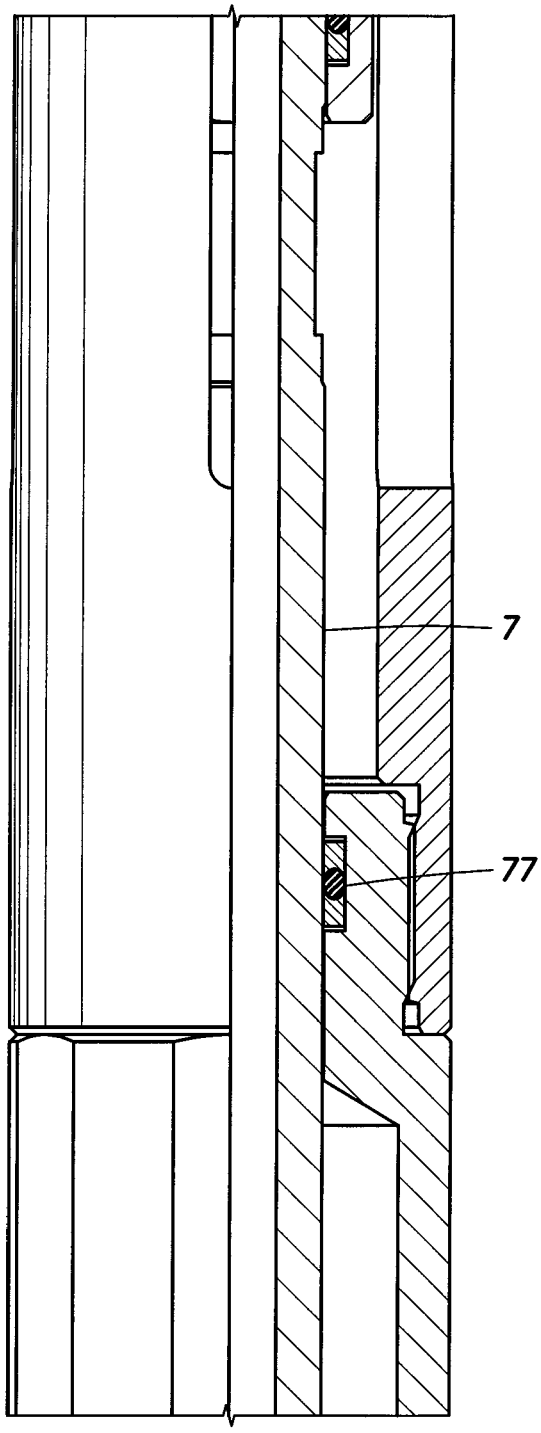
Figure 6K:
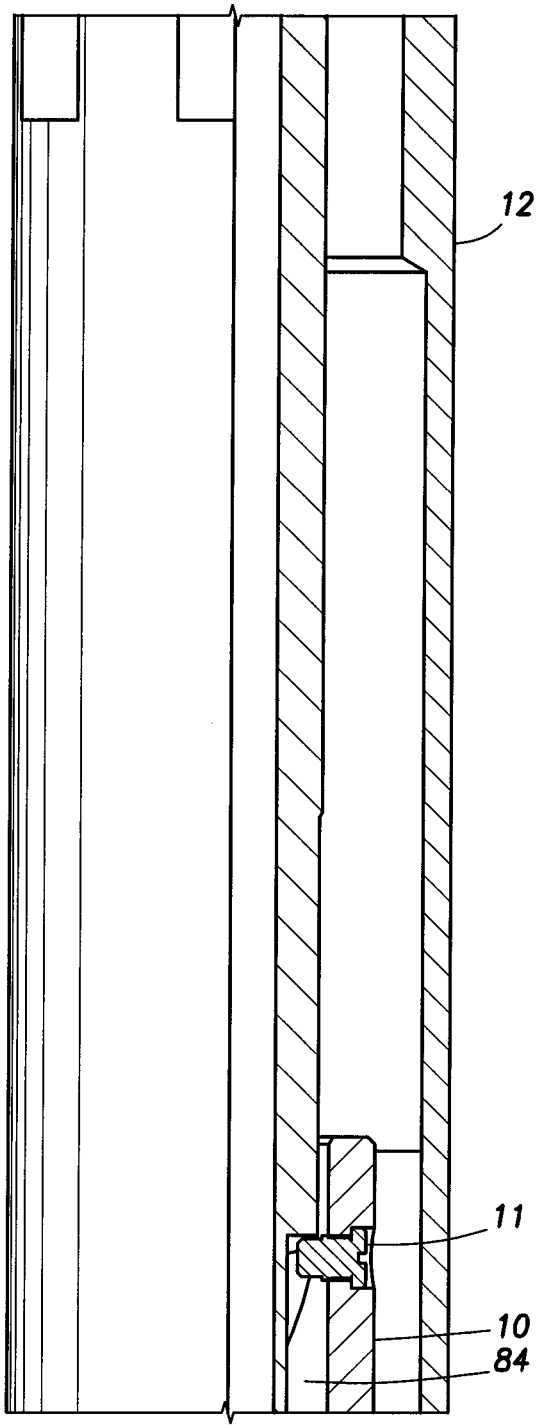
Figure 6L:
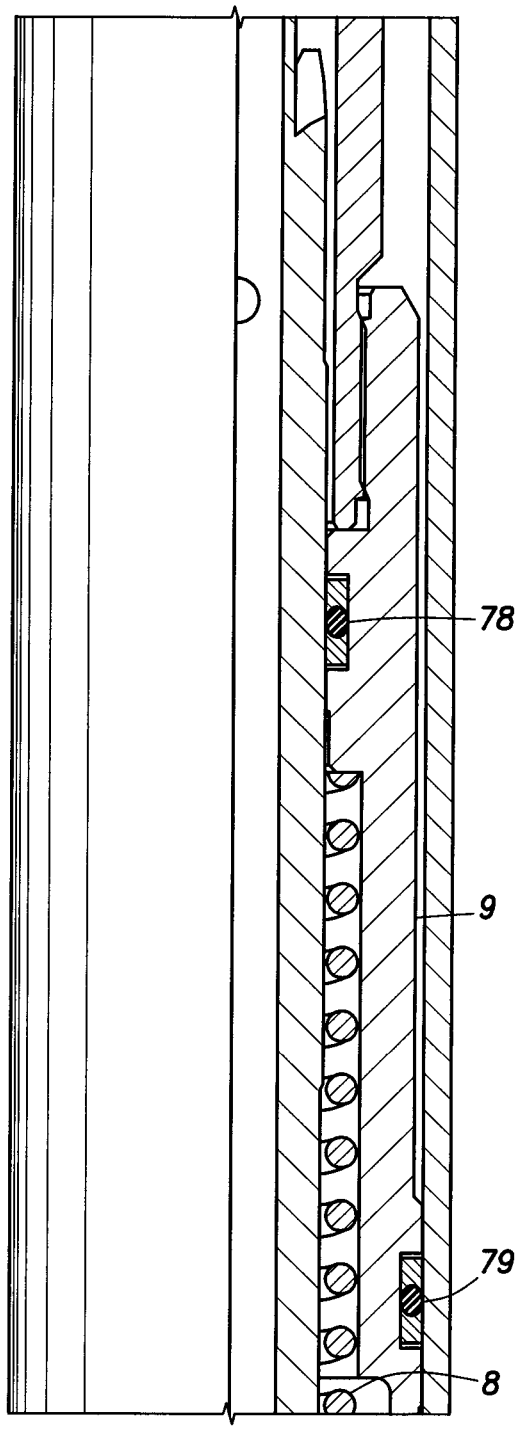
Figure 6M:
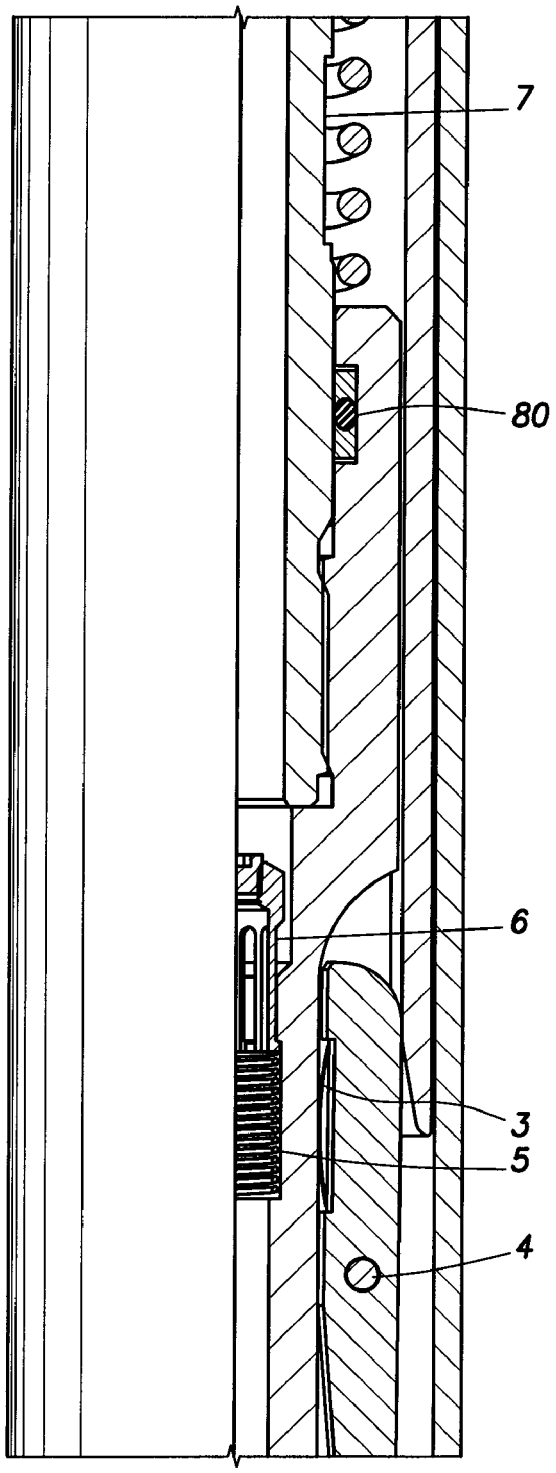
Figure 6N:
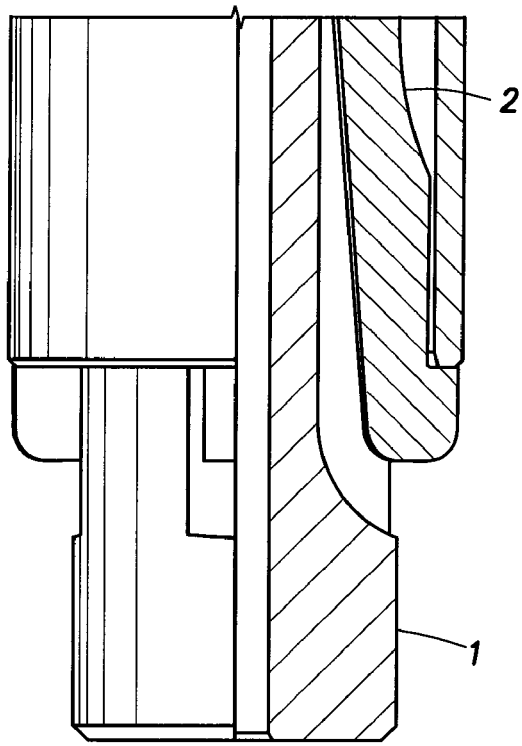

In operation, the zonal isolation device 100 of FIGS. 2A through 2N may be run into a well bore 260 on a tubing string 250 to a desired depth and set against casing 255, as shown in FIG. 1, or against an open borehole wall in the event of open hole testing. During run in, the zonal isolation device 100 may be submerged in reservoir fluid, workover fluid, or a combination thereof. Additionally, a fluid flow below the amount required to activate the velocity check valve 6 may be used prior to setting in order to remove any debris from around the zonal isolation device 100 that may interfere with setting or the formation of a hydraulic seal. Additionally, fluid may be circulated to the surface 205 prior to setting once the zonal isolation device 100 is positioned within the well bore 260 depending on the type of workover that may be performed. The zonal isolation device 100 may then be set using hydraulic fluid flow and pressure without the need for a rotational or longitudinal force supplied by the tubing string 250. The resulting set configuration of the zonal isolation device 100 is shown in FIGS. 6A through 6N, which correspond to the run-in cross-sectional views shown in FIGS. 2A through 2N except that the zonal isolation device 100 is shown in the actuated position.

In an embodiment, the zonal isolation device 100 is set by applying fluid flow to the zonal isolation device 100, typically by applying fluid flow through the coiled tubing 250 at the surface 205 of the well 260. The fluid flows down through the flow bore 106 of the stinger 42, through the port 81 in the ported retrieving head 34, and into the annular gap 60. When the balanced valve 32 is open, the fluid flows from the annular gap 60 through port 83 in the bypass body 31, and back to the interior of the upper mandrel 29. The fluid may then flow through the interior 131 of the upper mandrel 29 and lower J-slot mandrel 7 to the velocity check valve 6. Once the set point flow rate is achieved, the velocity check valve 6 closes against the force of biasing spring 5 and allows fluid pressure to build within the zonal isolation device 100. The pressure increase results in a pressure differential between the interior of the zonal isolation device 100 and the surrounding well bore 260.

The piston 9 may be actuated due to the pressure differential between the interior of the zonal isolation device 100 and the well bore 260. The top of the piston 9 is exposed to the interior pressure of the zonal isolation device 100 due to the port 85 in the lower J-slot mandrel 7. The lower side of the piston 9 is exposed to the well bore pressure below the zonal isolation device 100 due to the open end of the piston case 12. The increased pressure on the interior of the zonal isolation device 100 causes the piston 9 to move down relative to the piston case 12. The piston spring 8 is biased to push the piston 9 up and is counteracted by the differential pressure acting across the piston 9. The resulting force initially causes the piston case 12 to move up, driving the slotted case 30 into the lower wedge 25. The resulting force may be sufficient to cause shear screw 75 to fail, allowing for movement between the upper mandrel 29 and the lower wedge 25. The lower wedge 25 may then move under the lower slips 71, causing the lower slips 71 to engage the casing and prevent further upward movement of the piston case 12. The differential pressure across the piston 9 continues to move the piston 9 in a downward direction relative to the piston case 12. The upper mandrel 29, which is connected to the lower J-slot mandrel 7, then moves in a downward direction until the bypass body 31 on the retrieving head 120 engages the upper body 19 on the packer assembly 130. Continued movement of the piston 9 in a downward direction may result in the piston 9 engaging the upper portion of the lock body 1. When the piston 9 is in this state, any further downward movement is directly transferred to the upper mandrel 29 due to the connection between the lock body 1 and the lower J-slot mandrel 7.

Once the bypass body 31 has engaged the upper body 19, the resilient sealing elements 16, 17 may begin to be compressed. The downward force of the piston 9 may also begin to set the upper slips 70 and engage the ratchet 27. Prior to compressing the resilient sealing elements 16, 17 or setting the upper slips 70, shear screw 74 must be broken to allow for movement between the ratchet mandrel 13 and the slip body 21. The hydraulic force across the piston 9 may provide a sufficient force to overcome the shear strength of shear screw 74. As the upper mandrel 29 moves down, the resilient sealing elements 16, 17 compress, forcing the resilient sealing element material outward to engage and form a seal against the casing 255. The upper wedge 14 may move under the upper slips 70 causing the upper slips 70 to move outwards and engage the casing 255. As the resilient sealing elements 16, 17 are compressed, the depression 90 in the upper mandrel 29 may move into alignment with the inner portion 91 of the ratchet 27. The downwardly facing teeth 88 of the ratchet 27 may then move inward and engage the corresponding saw-tooth profile 89 on the ratchet mandrel 13. Upon engagement, the teeth 88, 89 lock together due to the inward force of the ratchet spring 28 on the ratchet 27. The interaction between the downwardly facing teeth 88 of the ratchet 27 and the saw-tooth profile 89 on the ratchet mandrel 13 prevents any downward movement of the lower wedge 25 relative to the ratchet mandrel 13. Thus, the ratchet 27 holds the lower wedge 25 and the ratchet mandrel 13 in a set position so as to continue to exert a force on the packer assembly 130 components and squeeze the resilient sealing elements 16, 17 into engagement with the surrounding casing. The resulting packer assembly 130 configuration is shown in FIGS. 6E through 6H.

The piston 9 may be fully compressed once the resilient sealing elements 16, 17 and the upper slips 70 have been set. The compression of the piston 9 may have moved the lock body 1 and lower portion of the locking arm 2 below the lower edge of the piston case 12. The lower portion of the piston 9 may also have moved between the upper portion of the locking arm 2 and the piston case 12, which may result in the lower portion of the locking arm 2 moving outwards to engage the lower edge of the piston case 12. The locking arm 2 prevents the lower J-slot mandrel 7 from moving relative to the piston case 12 during use, which could result in the release of the ratchet 27 from the ratchet mandrel 13. During actuation, the bottom lug body 10 and the lower J-slot pin 11 reciprocate through position 182 on the lower J-slot 84 to the actuated position 181, which may prevent the bottom lug body 10 and piston 9 from moving up. The pressure may then be relieved from the zonal isolation device 100. The piston spring 8 maintains the piston 9 and the bottom lug body 10 in the actuated position 181 until the hydraulic setting mechanism 140 is unlocked, as described in more detail below. The resulting hydraulic setting mechanism 140 configuration is shown in FIG. 6H through 6N.

The coiled tubing string 250 may be removed once the zonal isolation device 100 is set and locked to allow for a workover procedure to take place. The coiled tubing string 250 may be removed by longitudinally cycling the tubing string 250 and overshot 110 in order to move the rotator lug 36 through the upper J-slot 82 in the retrieving head 34. The upper J-slot 82 may only have one releasable position 172 in order to prevent inadvertent disconnection. The longitudinal cycling of the overshot 110 may not be possible unless the zonal isolation device 100 is set and locked in order to allow the overshot 110 to move relative to the retrieving head 120. Once the rotator lug 36 is in the releasable position 172, a bottom-up force must be applied in order to cause the ring spring 40 to move over the balanced valve ring 87. In an embodiment, it may take from 500 to 5,000 pounds of force to move the ring spring 40 over the balanced valve ring 87. Once the ring spring 40 moves over the balanced valve ring 87 the tension force is released, which may provide an observable indication at the surface 205 that the overshot 110 has been removed from the retrieving head 120. The removal of the overshot 110 results in the closing of the balanced valve 32, which may seal due to the internal seal 33 and the O-ring seals 62, 63. The closure of the balanced valve 32 substantially blocks fluid flow into or through the zonal isolation device 100, thereby preventing increased fluid pressure above the zonal isolation device 100, for example resulting from a workover, from inadvertently actuating the hydraulic setting mechanism 140. Once the overshot 110 is released from the zonal isolation device 100, the coiled tubing string 250 may be moved uphole along with any tools attached to the tubing string and a workover or testing procedure may be performed. Prior to performance of any workover, a protective layer of sand may optionally be applied to the top of the actuated zonal isolation device 100.

Referring again to FIG. 1 and FIGS. 6A through 6N, when the resilient sealing elements 16, 17 of the zonal isolation device 100 are expanded into sealing engagement with the casing 255, the resilient sealing elements 16, 17 function to selectively isolate the upper well bore portion from the lower well bore portion that is exposed to reservoir pressure. In the embodiment depicted in FIGS. 6A through 6N, the zonal isolation device 100 is a bridge plug that may seal the lower portion of the well bore 260 from the upper portion. Alternatively, the zonal isolation device 100 may comprise an internal valve, for example, as part of the balanced valve 32, that may selectively allow fluid to flow in only one direction in the well. Such a valve may result in an embodiment in which the zonal isolation device 100 is a fracture plug.

In an embodiment, the actuating force will continue to be maintained on the packer assembly 130 throughout its service life due to the locking mechanism 160 and the ratchet 27. When the packer assembly 130 is mechanically and/or thermally loaded during its operational life, the resilient sealing elements 16, 17 will not be the only components to expand and contract and thereby become spongy to leak over time. Instead, the locking mechanism 160 ensures that the ratchet 27 will retain the setting force on the slips 70, 71, the wedges 14, 25, and the resilient sealing elements 16, 17. However, a long term setting force may not be required if the zonal isolation device 100 is used as a temporary tool.

Upon completion of the workover or testing procedure, the zonal isolation device 100 may be unlocked and reset through the application of hydraulic fluid flow, pressure, and longitudinal force. To retrieve the zonal isolation device 100, the tubing string 250 with the overshot 110 attached may be lowered to the actuated zonal isolation device 100. Upon descending to retrieve the zonal isolation device 100, fluid may be pumped or flowed through the overshot 110 so as to wash any debris or sand off the top of the retrieving head 120. Once the debris is clear, the overshot 110 is placed on the retrieving head 120. Weight in the same amount used to remove the overshot 110 is applied in a downward direction to move the ring spring 40 over the balanced valve ring 87 and open the balanced valve 32. Weight may then be set down on the zonal isolation device 100 so that the rotating lug 36 moves to the intermediate position 173 on the upper J-slot 82.

The zonal isolation device 100 may then be reactuated in a method similar to the method of setting. Fluid flow is applied to the zonal isolation device 100 in order to close the velocity check valve 6. Once the velocity check valve 6 is closed, fluid pressure is applied to actuate the piston 9. As the piston 9 moves down, the lower J-slot pin 11 cycles into the intermediate position 183 within lower J-slot 84. The fluid pressure is then relieved from the zonal isolation device 100, allowing the piston 9 to move up in response to the force of the piston spring 8. This moves the lower J-slot pin 11 into the unactuated position 180. The lower portion of the piston 9 then moves above the locking arm 2, allowing for the lock spring 3 to bias the locking arm 2 into an unlocked position and release it from the lower edge of the piston case 12. This may release the lower J-slot mandrel 7 and the upper mandrel 29, which may allow for movement relative to the externally disposed components. A bottom-up force may then be applied to the tubing string 250 in order to raise the upper mandrel 29 so that the depression 90 in the upper mandrel 29 moves above the ratchet 27. The inner portion 91 of the ratchet 27 may then move outwards so that the ratchet 27 is released from engagement with the ratchet mandrel 13. Once the ratchet 27 is released, the resilient sealing elements 16, 17 and slips 70, 71 may be released due to the lack of an applied force from the piston 9 and freedom of movement between the ratchet mandrel 13 and the lower wedge 25. The slips 70, 71 may return to an unactuated position in response to the force of the slip retaining springs 23. Once the resilient sealing elements 16, 17 and slips 70, 71 are released, the zonal isolation device 100 may be in a reset state and may be ready to be set at another location within the well bore, using the setting method disclosed herein, or retrieved from the well bore 260 altogether.

Figure 7A:
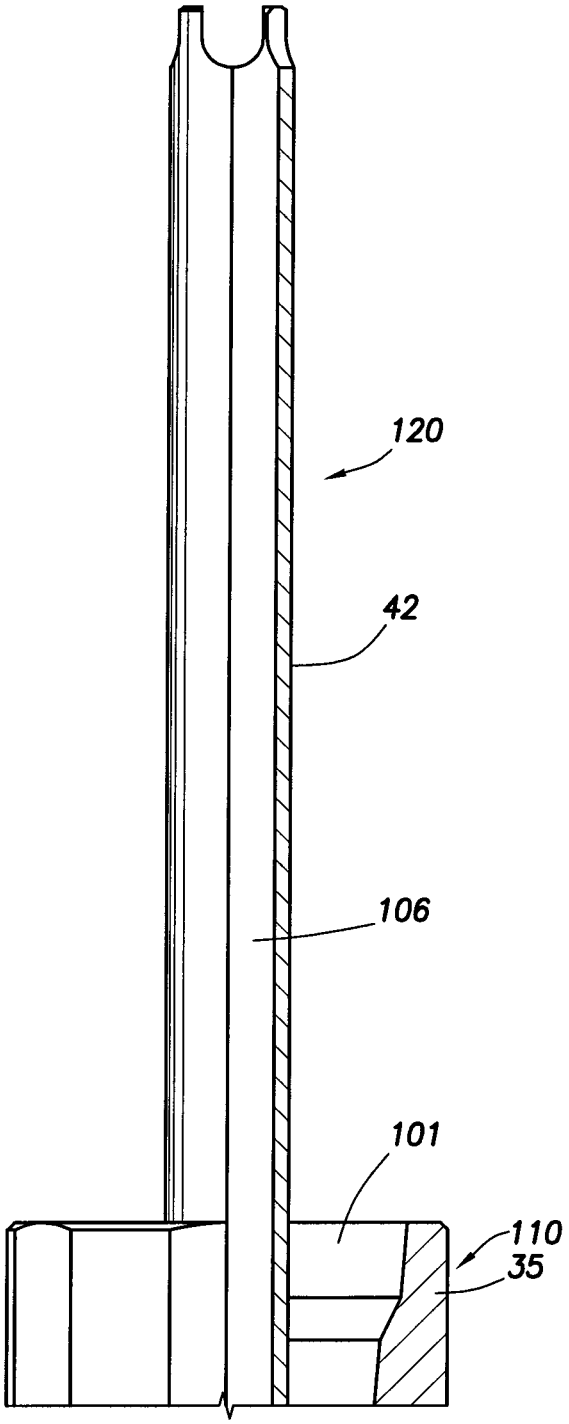
FIGS. 7A through 7O, when viewed sequentially from end-to-end, provide a cross-sectional side view of another embodiment of a zonal isolation device in a run-in configuration.

FIGS. 7A through 7O, when viewed from end to end, depict another embodiment of a zonal isolation device 300 in a run-in configuration. This embodiment of the zonal isolation device 300 has many components in common with the previously described zonal isolation device 100, and like components are identified with like reference numerals. However, as compared to the zonal isolation device 100 depicted in FIGS. 2A through 2N, the zonal isolation device 300 may include one or more of the following additional components: a resistance pad 343 depicted in side view in FIGS. 7B and 7C and depicted in plan view in FIG. 8; an expansion spring 319 depicted in FIGS. 7J through 7L; a split ring collar 337 and an associated lower connector 316 depicted in FIGS. 7K and 7L; a bottom lug body 311, a bottom lug rotating ring 312 and a bottom lug cap 314 depicted in FIGS. 7L and 7M; and a retaining sleeve 307 depicted in FIG. 7N. One of ordinary skill in the art will readily appreciate that the zonal isolation device 300 may include any one or more of these additional features, up to and including all of the additional features as shown in FIGS. 7A through 7O. Due to the many structural and operational similarities between the zonal isolation device 300 of FIGS. 7A through 7O and the zonal isolation device 100 of FIGS. 2A through 2N, the discussion that follows will focus on the additional components listed above and their function.

Figure 7B:
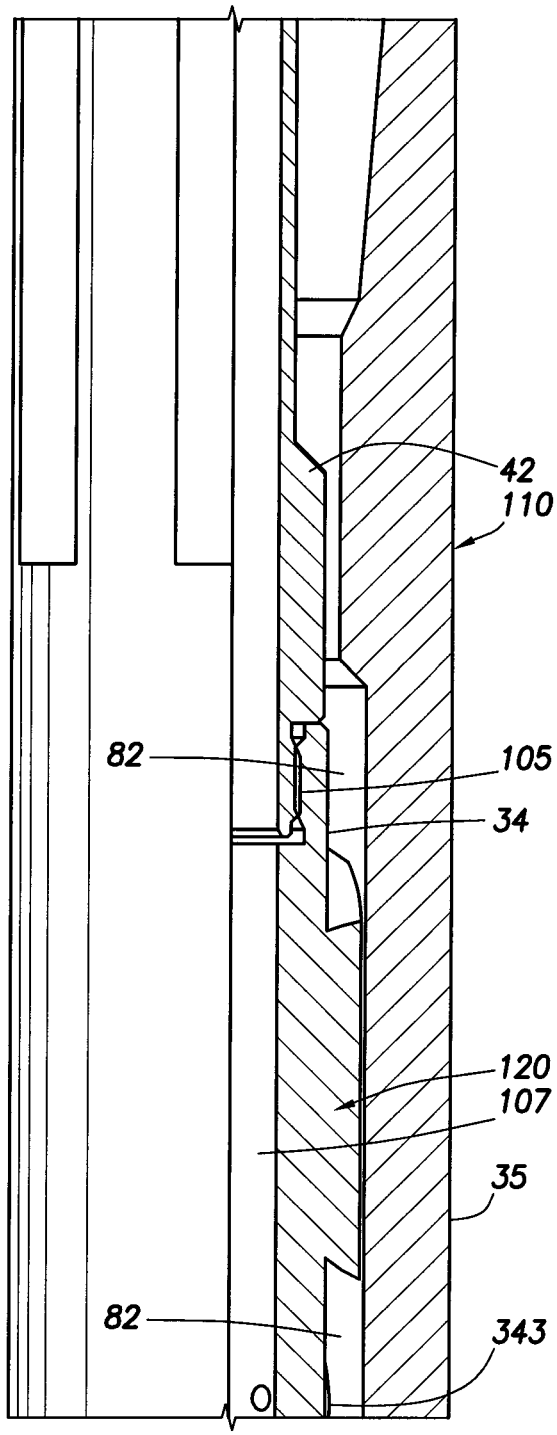
Figure 7C:
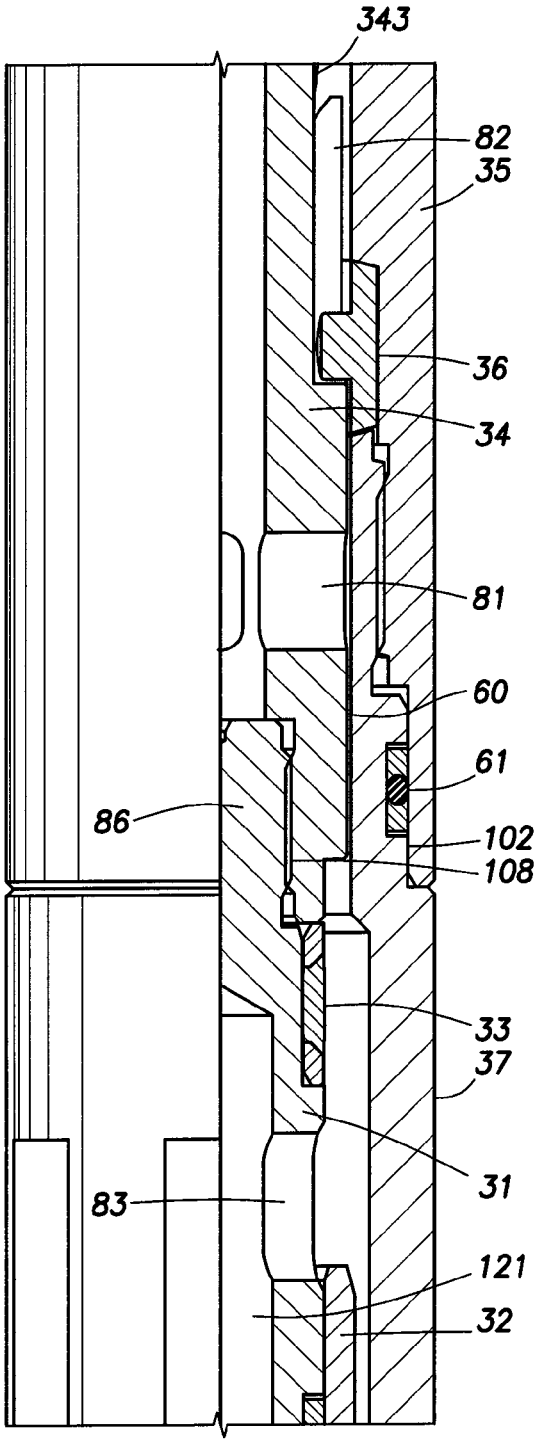
Figure 7D:
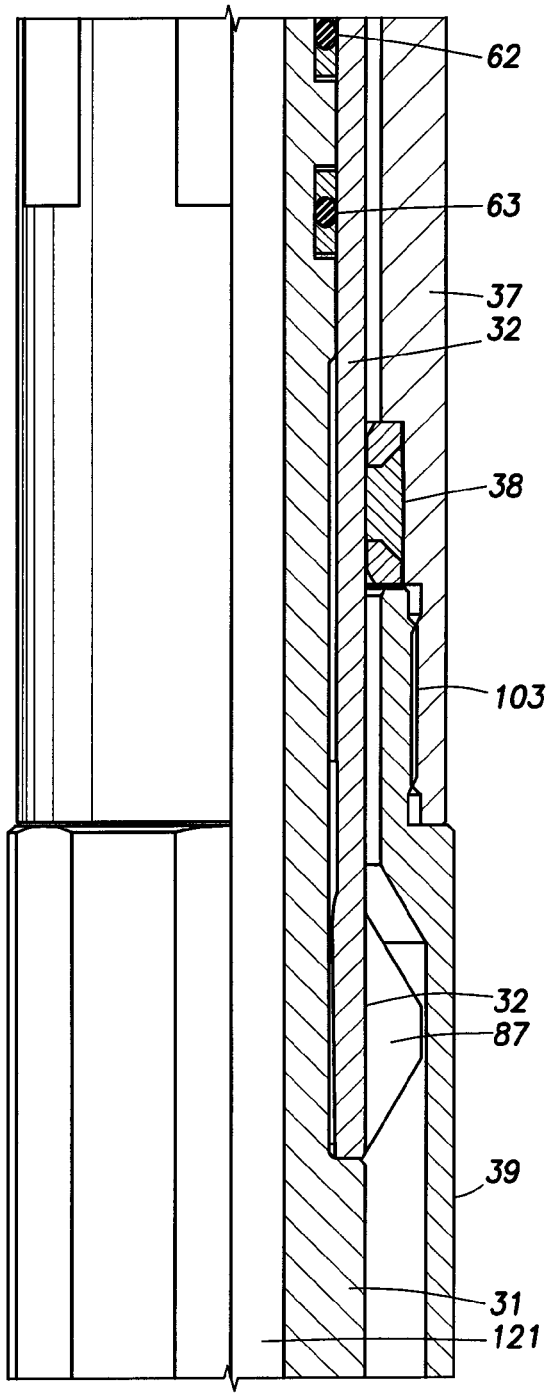
Figure 7E:
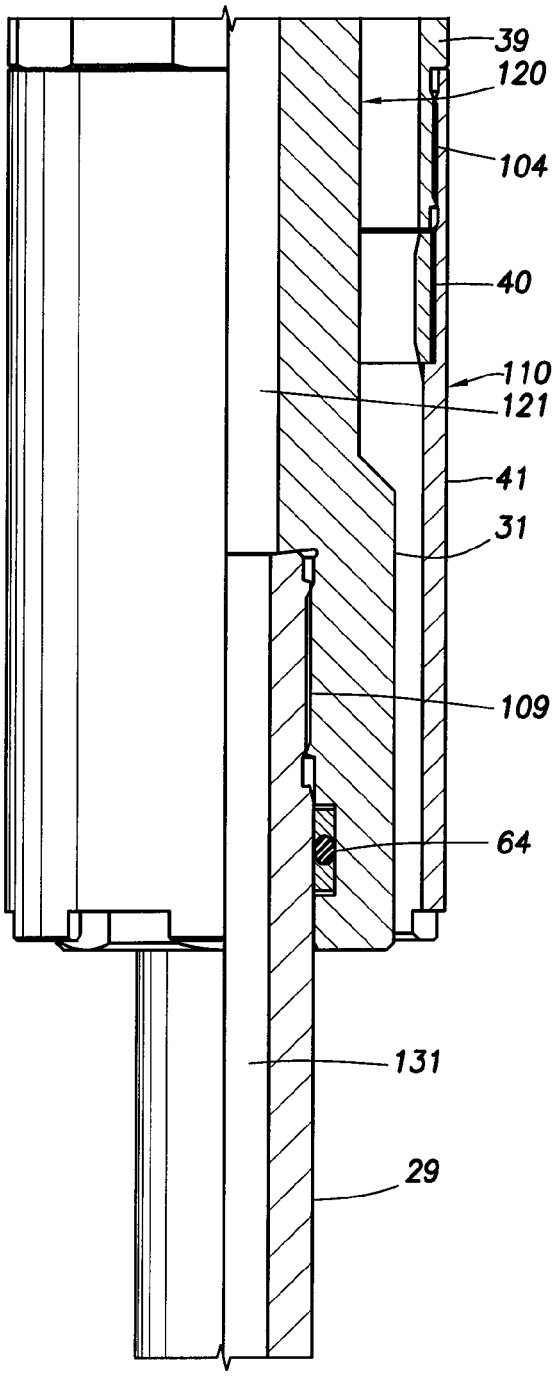
Figure 7F:
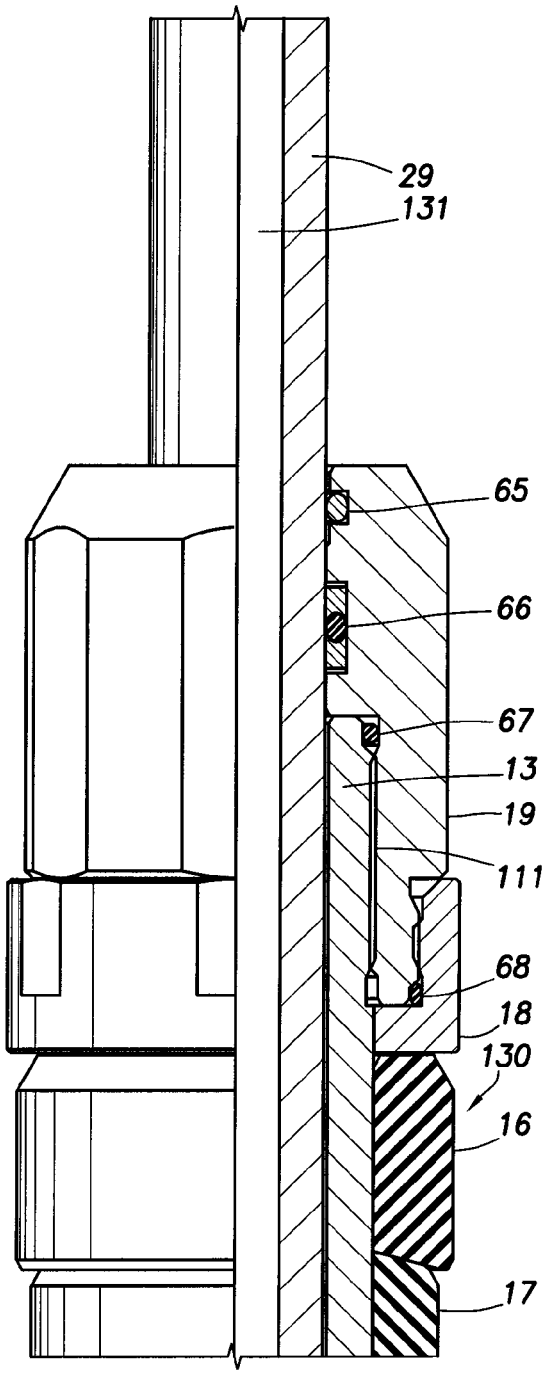
Figure 7G:
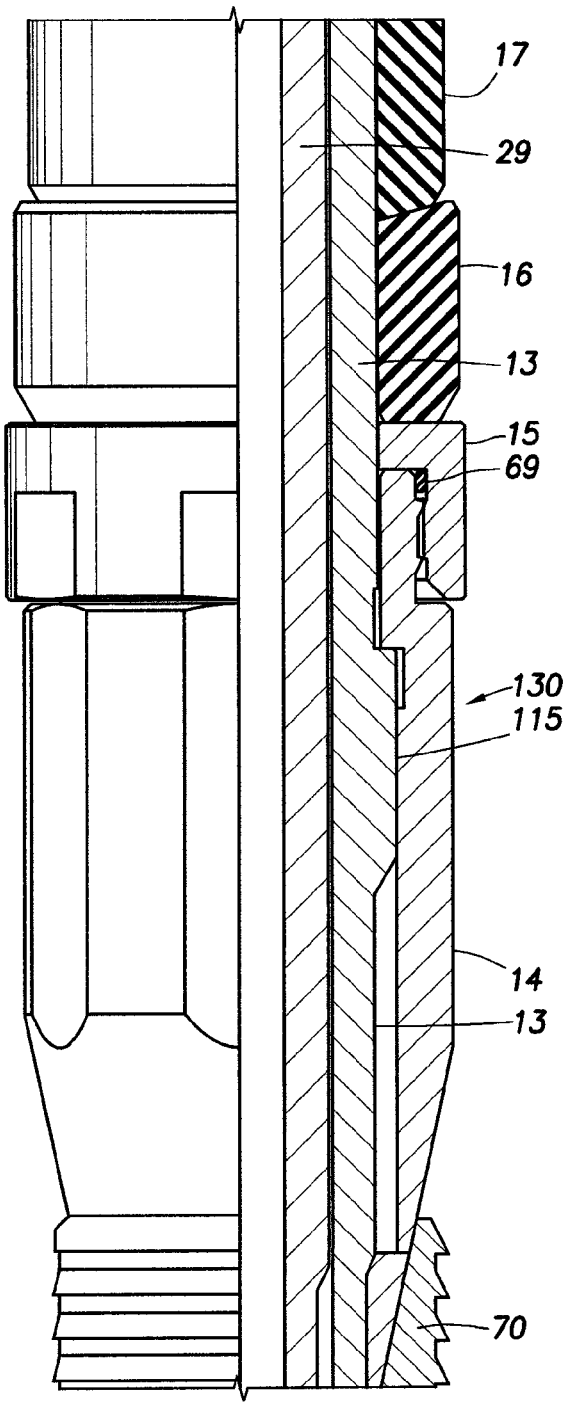
Figure 7H:
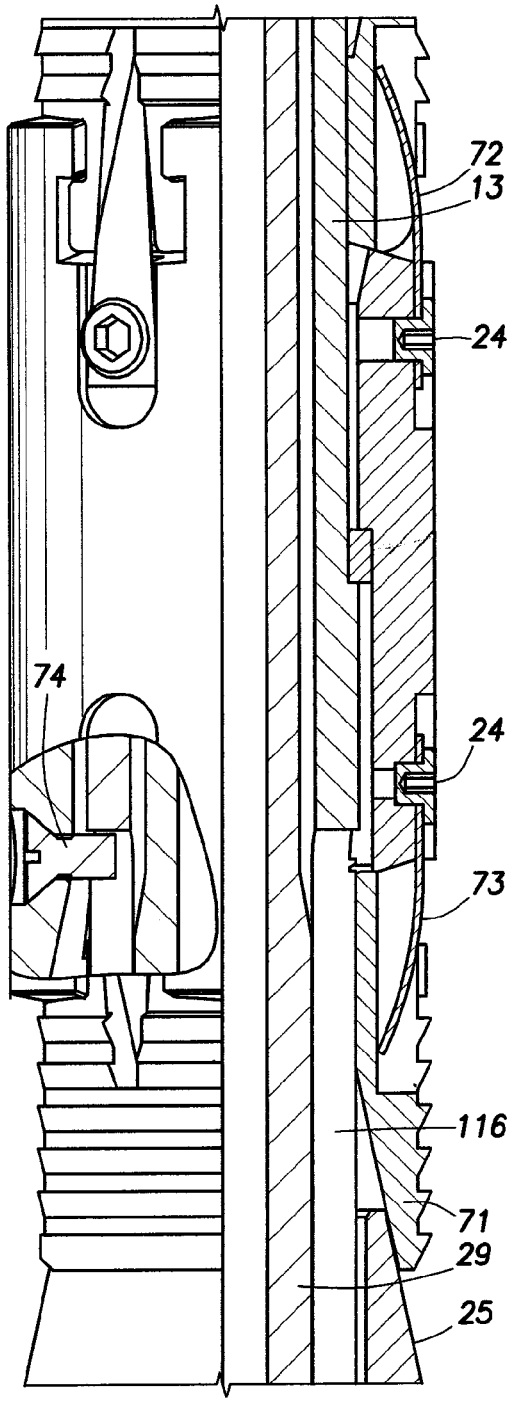
Figure 7I:
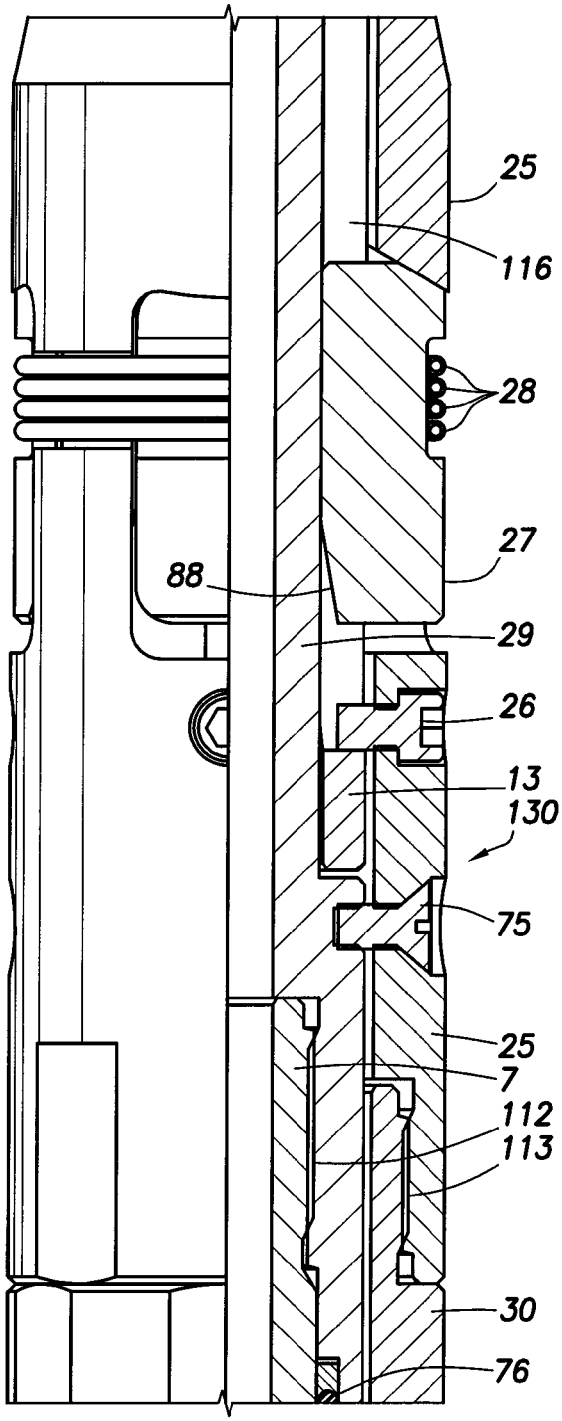
Figure 8:
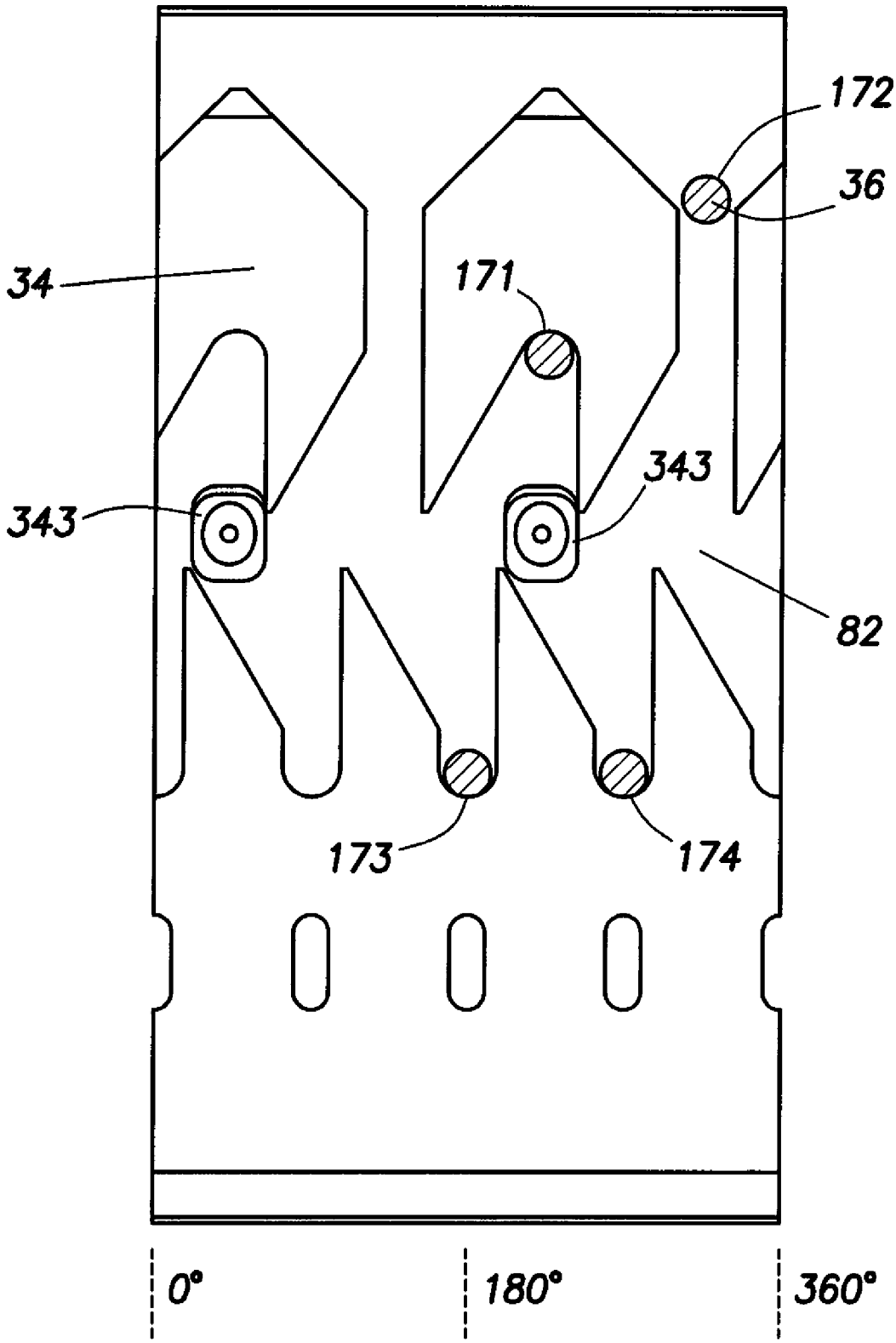
FIG. 8 illustrates the retrieving head J-slot angular positions with rotator lug positions for the zonal isolation device of FIGS. 7A through 7O.

Referring now to FIGS. 7A through 7E, the overshot portion 110 of the zonal isolation device 300 comprises a releasable section that connects the coiled tubing 250 to the retrieving head 120 through a rotating lug 36, which may travel in an upper J-slot 82 as shown in FIGS. 7B and 7C. As shown in FIG. 8, the upper J-slot 82 may have several rotating lug 36 positions, including a connected position 171, a releasable position 172, and intermediate positions 173, 174, for example. When the rotator lug 36 is engaged in the connected position 171, such as during run-in, the overshot 110 may not be released from the retrieving head 120. From this connected position 171, the rotator lug 36 may rotate to releasable position 172 in response to a cycling of the overshot 110. In an embodiment, the overshot 110 may require from 1 to 6 cycles to move the rotating lug 36 into the releasable position 172 to allow the overshot 110 to release from the retrieving head 120.

To prevent the rotating lug 36 from freely moving through the J-slot 82 from the connected position 171 to the releasable position 172, and thereby inadvertently disconnecting the overshot portion 110 from the retrieving head 120 during run-in, a resistance pad 343 may be connected into a sidewall of the ported retrieving head 34 to extend into the J-slot 82 as shown in FIGS. 7B, 7C and 8. If the zonal isolation device 300 encounters a restriction in the well bore 260 during run-in, for example, the rotating lug 36 will begin moving within the J-slot 82 until it engages the resistance pad 343, which provides an interference fit with the rotating lug 36. The resistance pad 343 thereby stops further movement of the rotating lug 36 through the J-slot 82 until a sufficient force is applied to push the rotating lug 36 beyond (over) the resistance pad 343. In one embodiment, the zonal isolation device 300 must be moved to the set position before a force sufficient to push the rotating lug 36 past the resistance pad 343 can be applied. Thus, the resistance pad 343 enables the operator to push down on the zonal isolation device 300 during run-in to move the device 300 past a restriction in the well bore 260 without inadvertently disconnecting the overshot portion 110 from the retrieving head 120.

Figure 7J:
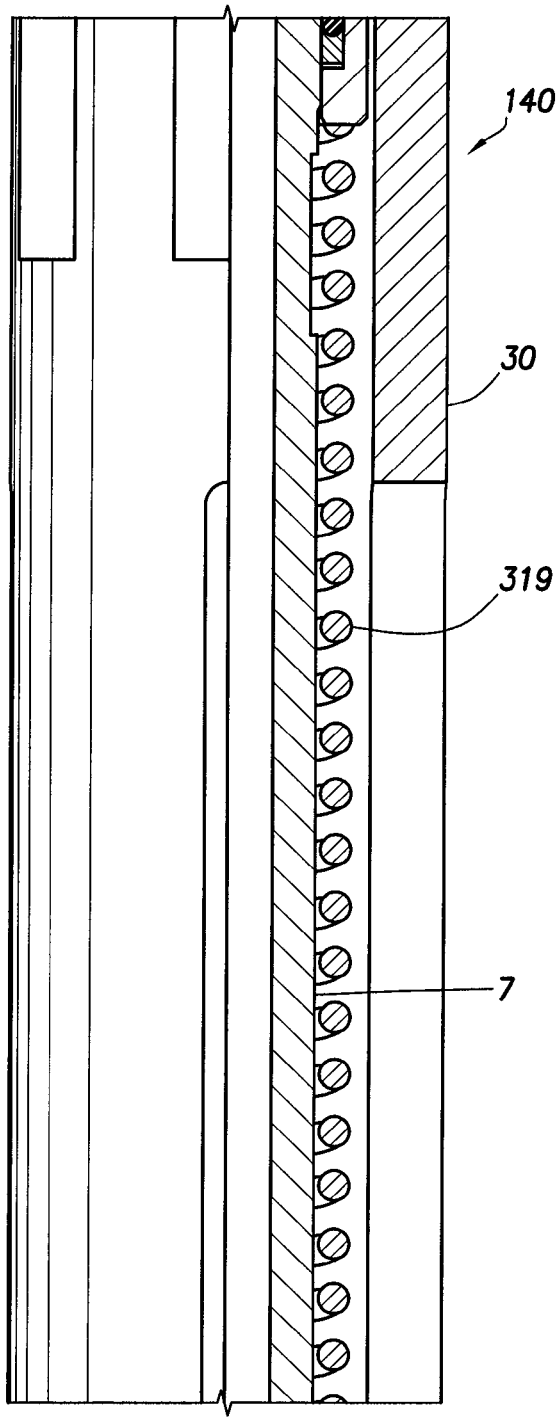
Figure 7K:
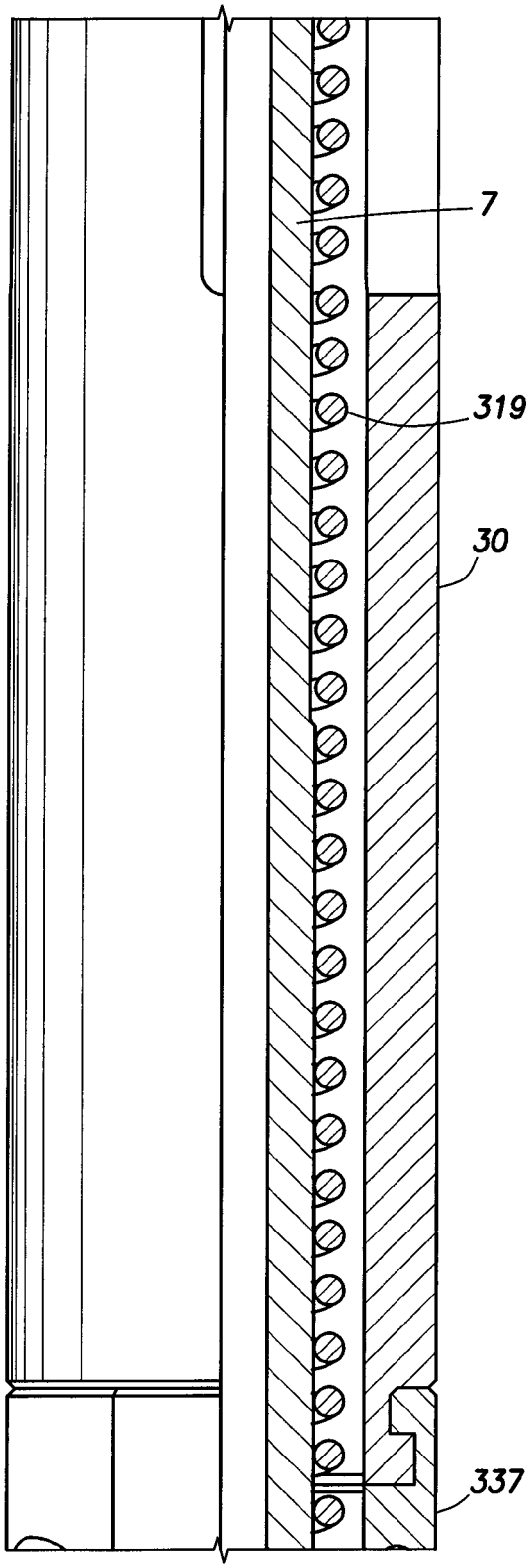
Figure 7L:
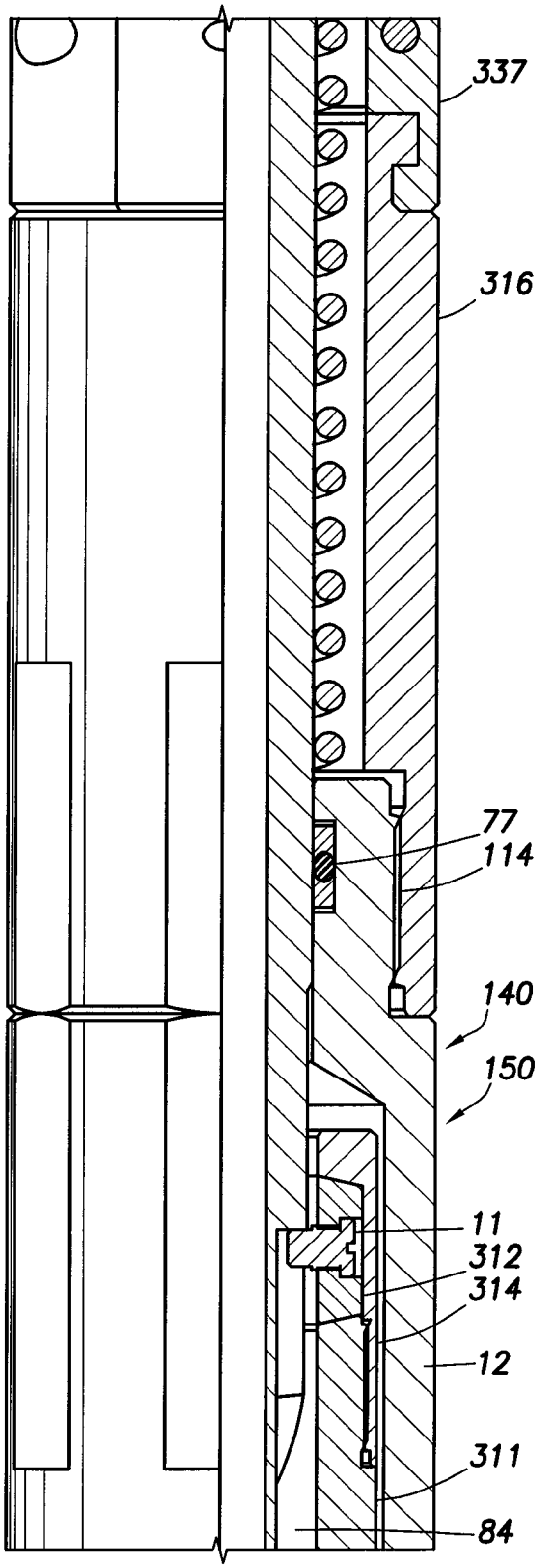

Referring now to FIGS. 7J through 7L, the zonal isolation device 300 may also comprise an expansion spring 319 disposed radially between the lower J-slot mandrel 7 and the slotted case 30, and extending longitudinally to engage the upper mandrel 29 at the upstream end of the expansion spring 319 and the piston case 12 at the downstream end of the expansion spring 319. The expansion spring 319 is designed to expand the zonal isolation device 300 to approximately a fully extended run-in position by overcoming the frictional forces of the O-ring seals, such as O-ring seals 64, 65, 66 and 76 that engage upper mandrel 29 and O-ring seals 77, 79 and 80 that engage the lower J-slot mandrel 7. Without the expansion spring 319, these O-ring seals may prevent the zonal isolation device 300 from fully expanding to the run-in position after the device 300 is released from a set position. As shown in FIGS. 7K and 7L, a split ring collar 337 and a lower connector 316 may also be installed longitudinally between the slotted case 30 and the piston case 12 to facilitate the installation of the expansion spring 319 during assembly of the zonal isolation device 300.

Figure 7M:
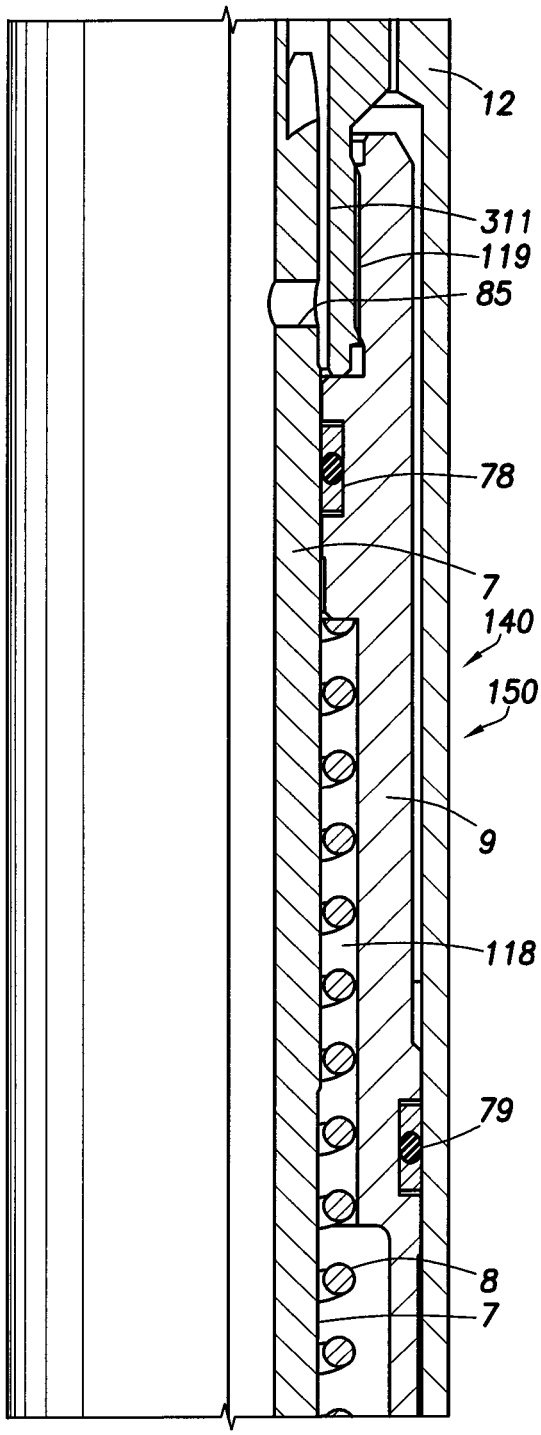

Referring now to FIGS. 7L and 7M, in this embodiment, the bottom lug body 10 (shown in FIGS. 2K and 2L) of the previously described zonal isolation device 100 is replaced in the alternate embodiment of the zonal isolation device 300 by three components, namely, a bottom lug body 311, a bottom lug rotating ring 312 and a bottom lug cap 314. When assembling the zonal isolation device 100 of FIGS. 2A through 2N, a downward force is exerted on the piston spring 8 to properly align the components for the lower J-slot pins 11 to be installed, while simultaneously threading the bottom lug body 10 onto the piston 9 via threads 119. In contrast, when assembling the zonal isolation device 300 of FIGS. 7A through 7O, the lower J-slot pins 11 may be installed, and then a downward force is applied to the piston spring 8 resulting from threading the bottom lug cap 314 onto the bottom lug body 311 and onto the piston 9.

Figure 7N:
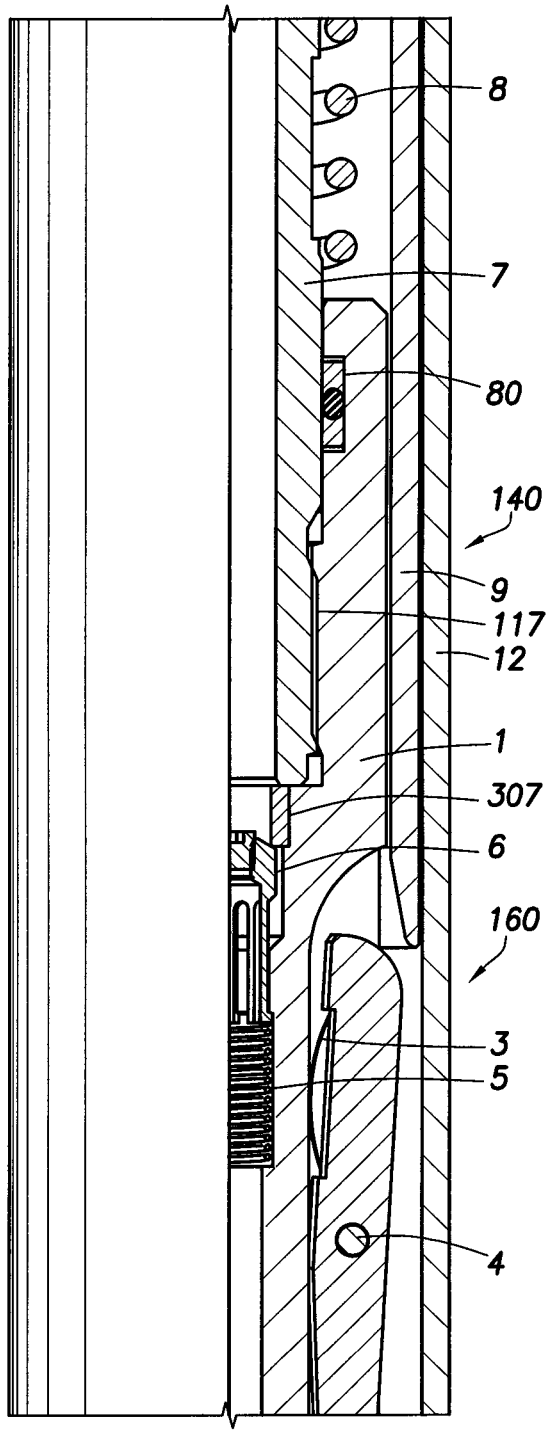
Figure 70:
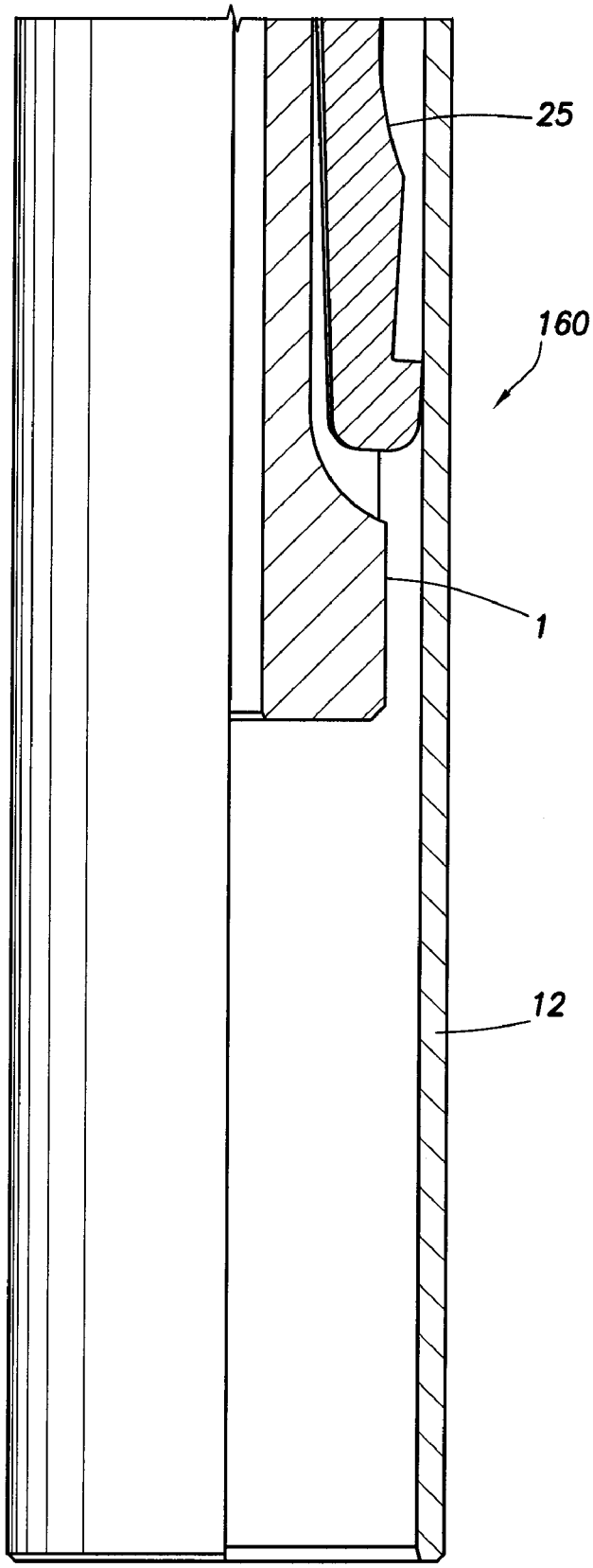

Referring now to FIG. 7N, the zonal isolation device 300 may also include a retaining sleeve 307 that ensures the velocity check valve 6 remains seated within the lock body 1 when pressure builds below the velocity check valve 6 and then that pressure is quickly released. Absent the retaining sleeve 307, this pressure reversal may cause the fingers of the velocity check valve 6 to collapse, which may allow the velocity check valve 6 to dislodge from its position within the lock body 1 and move upwardly into engagement with the lower J-slot mandrel 7.

Setting a downhole tool, such as a zonal isolation device 100, 300, multiple times in one trip into the well bore 260 as described above is more cost effective and less time consuming than setting a downhole tool using conventional methods that may require making one or more trips into the well bore 260 to insert and remove a zoning isolation device 100, 300. The hydraulic setting mechanism 140 may also provide sufficient actuating force to completely set a zonal isolation device 100, 300. The foregoing description of the specific embodiment of the zonal isolation device 100, 300 and the method for setting the zonal isolation device 100, 300 using the hydraulic setting mechanism 140 within a well bore 260 has been presented for purposes of illustration and description and is not intended to be exhaustive or to limit the invention to the precise forms disclosed. Obviously many other modifications and variations are possible. In an embodiment, the order of the particular components may vary. For example, the hydraulic setting mechanism 140 may be positioned above the packer assembly 130, or on a component level, the slips 70, 71 may be positioned above the resilient sealing elements 16, 17. Alternatively, the specific type of downhole tool, or the particular components that make up the downhole tool could be varied. For example, instead of a packer assembly 130, the zonal isolation device 100, 300 could comprise an anchor or another type of plug. The particular use of the zonal isolation device 100, 300 could also vary and may not necessarily be used for a well workover. For example, the zonal isolation device may be run as a bridge plug in a temporary abandonment procedure in order to allow for a cost effective retrieval procedure if the well is reopened. Further, the zonal isolation device 100, 300 may be a permanent tool, a recoverable tool, or a disposable tool, and other removal methods besides retrieval and resetting may be employed. For example, in the event of a malfunction, one or more components of the zonal isolation device 100, 300 may be formed of materials that are consumable when exposed to heat and an oxygen source, or materials that degrade when exposed to a particular chemical solution, or biodegradable materials that degrade over time due to exposure to well bore fluids.

While various embodiments of the invention have been shown and described herein, modifications may be made by one skilled in the art without departing from the spirit and the teachings of the invention. The embodiments described here are representative only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What we claim as our invention is:

1. A zonal isolation device comprising:

a packer assembly comprising opposable slips;

an internal setting mechanism operable to actuate the packer assembly from an unset position to a set position, the internal setting mechanism comprising:

a piston case; and a piston selectively at least partially carried within the piston case;

wherein the piston case and the piston are configured to selectively move in opposing longitudinal directions in response to a differential pressure applied to the internal setting mechanism; and a locking mechanism selectively operable to maintain the packer assembly in the set position and to release the packer assembly from the set position, wherein the locking mechanism is configured for actuation in response to the differential pressure applied to the internal setting mechanism, the locking mechanism comprising a biased locking arm configured to selectively restrict longitudinal movement of a mandrel relative to the piston case and wherein the biased locking arm is selectively restricted from movement in response to a location of the piston;

wherein the zonal isolation device is resettable and retrievable; and wherein the piston is connected to a pin that is selectively carried within a continuous J-slot and wherein movement of the piston is selectively restricted in response to where within the continuous J-slot the pin is located.

2. A method for setting a zonal isolation device within a well bore, comprising:

running the zonal isolation device in an unset position to a first location within the well bore on a work string;

applying a first differential pressure between the work string and the well bore;

actuating the zonal isolation device to a set position in response to the first differential pressure alone, wherein the actuating the zonal isolation device to a set position comprises moving adjacent components of the zonal isolation device longitudinally toward each other so that at least one of the adjacent components also moves radially outward and securing a piston case by a ratcheting action;

locking the zonal isolation device in the set position in response to the first differential pressure, wherein the locking comprises selectively restricting movement of a mandrel relative to the piston case by actuating a biased locking arm;

releasing the zonal isolation device from the work string, the releasing comprising applying a longitudinal force through the work string to a lug carried by the work string so that the lug is moved within an upper J-slot of the zonal isolation device;

performing the well bore operation;

reconnecting the work string to the zonal isolation device;

applying a second differential pressure between the work string and the well bore;

unlocking the zonal isolation device from the set position in response to the second differential pressure alone; and moving the zonal isolation device to the unset position.

3. The method of claim 2 further comprising:

running the zonal isolation device in the unset position to a second location within the well bore on the work string;

applying a third differential pressure between the work string and the well bore; and actuating the zonal isolation device to the set position in response to the third differential pressure alone, wherein the actuating the zonal isolation device to a set position comprises moving adjacent components of the zonal isolation device longitudinally toward each other so that at least one of the adjacent components also moves radially outward.

4. The method of claim 2 further comprising retrieving the zonal isolation device from the well bore, the retrieving comprising applying a longitudinal force through the work string to a lug carried by the work string so that the lug is moved within the upper J-slot of the zonal isolation device.

5. An assembly, comprising:

a zonal isolation device comprising:

a packer assembly comprising opposable slips;

a setting mechanism operable to actuate the packer assembly from an unset position to a set position in response to differential pressure, the setting mechanism comprising a piston case and a piston selectively at least partially carried within the piston case, wherein the piston case and the piston are configured to selectively move in opposing longitudinal directions in response to the differential pressure; and a locking mechanism operable to lock and unlock the packer assembly from the set position in response to differential pressure, wherein the locking mechanism selectively restricts movement of a mandrel relative to the piston case by actuating a biased locking arm; and a coiled tubing work string connected to the zonal isolation device;

wherein the zonal isolation device comprises at least one continuous J-slot and a lug selectively moved within the J-slot in response to at least one of a longitudinal force and the differential pressure force.

6. The assembly of claim 5 wherein the zonal isolation device is resettable and retrievable.

7. The zonal isolation device of claim 1, wherein the internal setting mechanism is hydraulically actuated and wherein at least a portion of the internal setting mechanism is located below the opposable slips.

8. The zonal isolation device of claim 1, wherein the J-slot comprises at least one actuated position and at least one unactuated position and wherein the pin is selectively alternatingly associable with the at least one actuated position and the at least one unactuated position in response to the differential pressure.

9. The zonal isolation device of claim 1, wherein the packer assembly is not configured for actuation in response to a rotational force transmitted from a work string.

10. The zonal isolation device of claim 9, wherein the packer assembly may be set, unset, and reset within a well bore without retrieving the zonal isolation device from the wellbore.

11. The zonal isolation device of claim 10, wherein the zonal isolation device is a bridge plug.

12. The zonal isolation device of claim 1, wherein the differential pressure is applied to the internal setting mechanism through a mandrel port, the mandrel port being configured to provide a fluid path between an interior of the zonal isolation device and a top of the piston.

13. The zonal isolation device of claim 1, wherein the locking mechanism is operable to release the packer assembly from the set position in response to a subsequent pressure differential applied to the internal setting mechanism through a mandrel port, the mandrel port being configured to provide a fluid path between an interior of the zonal isolation device and a top of the piston.

14. The zonal isolation device of claim 1, wherein the biased locking arm is configured to rotate about a lock pin in response to longitudinal movement of the piston.

15. The method of claim 2, wherein a bottom-up force is applied to the work string to move the zonal isolation device to the unset position.

16. The method of claim 2, further comprising:

applying sand to the top of the actuated zonal isolation device after releasing the zonal isolation device from the work string and prior to performing the well bore operation.

17. The method of claim 2, wherein at least one of the first differential pressure and the second pressure differential is applied through a mandrel port of the mandrel, the mandrel port being configured to provide a fluid path to an interior of the zonal isolation device.

18. The assembly of claim 5, wherein the differential pressure is applied through a port of the mandrel, the port being configured to provide a fluid path to an interior of the zonal isolation device.

19. The assembly of claim 5, wherein the biased locking arm is configured to actuate in response to a longitudinal movement of the piston.

* * * * *